US005325646A

United States Patent [19]

Hallsten et al.

[11] Patent Number: 5,325,646

[45] Date of Patent: Jul. 5, 1994

[54] TANK COVER STRUCTURE

[75] Inventors: Jeffrey A. Hallsten; John Hallsten, both of Sacramento, Calif.

[73] Assignee: Hallsten Supply Co., Sacramento, Calif.

[21] Appl. No.: 932,491

[22] Filed: Aug. 20, 1992

[51] Int. Cl.[5] ..... E04B 1/32

[52] U.S. Cl. ..... 52/246; 52/282.1; 52/283; 52/763

[58] Field of Search ..... 4/498; 52/474, 483, 52/487, 490, 762, 763, 282.1, 283, 245, 246

[56] References Cited

U.S. PATENT DOCUMENTS 2,926,928 3/1960 Bennett .
3,172,508 3/1965 Doering et al. .
3,236,017 2/1966 Doering .
3,319,543 5/1965 Braeuninger et al. .
3,460,304 8/1969 Braeuninger et al. .
3,487,756 1/1970 Glaza et al. .
3,784,312 1/1974 Gordon .
3,840,908 10/1974 Greene .
4,266,381 5/1981 Deller .
4,599,842 7/1986 Counihan .
5,050,361 9/1991 Hallsten .

*Primary Examiner*—Carl D. Friedman
*Assistant Examiner*—Christopher T. Kent
*Attorney, Agent, or Firm*—Thomas M. Freiburger

[57] ABSTRACT

A cover for tank is formed from a plurality of panels attached together by cross members. The cover includes means for sealing the panels to the cross members, and means for sealing the panels and the cross members to the tank. The panels are constructed from a multiplicity of edge-to-edge planks. The planks may be connected together without welds, and the panels may be connected to the cross members without welds. The cover may be in the shape of an arch, or the shape of a dome. In another embodiment a dome-shaped cover may be formed from a plurality of panels each having the shape of a section of a circle. Each panel is connected between an adjacent pair of a plurality of radial members arranged in a radial pattern.

34 Claims, 21 Drawing Sheets

TANK COVER STRUCTURE

BACKGROUND OF THE INVENTION

The present invention relates in general to a cover for a tank. It relates in particular to a modular cover which may be shipped to a site in component form and assembled at the site.

There is an increasing need for covers for enclosing in and above ground tanks which are used for storing waste materials including sewage, chemical sludge, petroleum products and the like. The materials are stored for later disposal or treatment. Such a cover must be substantially gas tight for controlling odors in the vicinity of a tank site and for trapping potentially hazardous gases.

Tanks used for storing such treatments may have a span or diameter of fifty feet or more. It is generally necessary to support a tank cover only at the edge of a tank. Because of this such a tank cover must be capable of spanning a large distance.

A tank cover is generally too large to be conveniently or cost effectively shipped in an assembled form from a manufacturer to a site where it will be used. Because of this it is generally shipped as components and assembled at the site.

Prior art tank covers made of steel are heavy and expensive even to ship in component form. Further, such covers usually require welded connections and bolted connections in their assembly. As such, skilled personnel are generally necessary to carry out the assembly, and the assembly process may be lengthy and costly.

One approach to large-span tank covers and covers for similar purposes has been a geodesic dome type structure. These covers required skilled erecting labor and were quite costly as compared to the present invention.

There is a need for a site erectable substantially gas-tight tank cover which can be assembled with a minimum of welds or bolted connections. Such a cover should preferably be modular to reduce the inventory of components necessary for building covers in a wide range of shapes and sizes, and this is an object of the present invention described below.

U.S. Pat. No. 5,050,361, assigned to the assignee of the present invention, discloses a deck structure which is weldless and is site-erectable and which includes components similar to some of the components of the present invention. The disclosure of that patent is incorporated herein by reference.

SUMMARY OF THE INVENTION

The present invention is directed to a gas-tight cover for a tank or for other enclosures which may require spanning a large distance. The cover is designed to be shipped as a component package to a site where it will be used and erected at the site. The cover may be in the form of an arch or a dome and is configured to remain structurally sound and substantially gas-tight under repeated thermal cycling conditions.

Objects of the invention are accomplished by constructing the cover of components which may be connected together at the site without welds and with a minimum of bolted connections. Resilient seals between components of the cover and between the cover and the tank, serve to make the cover substantially gas-tight. The construction method and the seals also allow the cover to deflect under load to a predetermined extent for absorbing thermal expansion stresses and other environmental stresses to which the cover may be subjected.

In one preferred embodiment, the cover comprises a plurality of panels and a plurality of cross members. Each panel is formed by a multiplicity of planks connected together edge-to-edge. The panels are arranged side-by-side with adjacent panels connected together by a cross member. The ends of the cross members engage cover support means attached to the tank.

Each panel includes a side member extending transversely along at least one edge of the panel. The side member has plank receiving means therein. The side member and the cross member have interconnecting means therein for providing a substantially gas-tight connection between the panel and a cross member.

The panels include a sealing member which engages the cover support means for providing a substantially gas-tight seal between the cover and the tank.

The panels may be generally rectangular and the cross members configured to provide a cover having an arch-like form. Alternatively, each panel may be generally in the form of a section of a circle and the cross members configured to provide a cover having a dome-like shape.

In another embodiment of the invention, a dome-shaped cover for a tank is constructed from a plurality of panels, each generally in the shape of a segment of a circle and plurality of radial members arranged alternately in a radial pattern. Each panel includes a multiplicity of planks connected together edge-to-edge. Adjacent panels are connected together by a support member.

The radial members are preferably each clamped at one end thereof to a compression unit located at about the center of the radial pattern. The other end of the radial member engages a tension ring attached to the tank.

In a preferred embodiment, the compression unit includes a compression ring and upper and lower annular portions assembled concentrically around the compression ring such that the assembly forms an outward facing channel in the compression unit for receiving the ends of the radial members. The support members are clamped to the compression unit by means of wedge-shaped resilient blocks, bolted to the compression ring. One block is located between each pair of adjacent radial members. The blocks are configured such that when they are bolted to the compression ring they expand to clamp the ends of the radial members in the outward-facing channel of the compression unit.

In all of the above described embodiments, a preferred means for connecting a panels to a cross member or radial member includes an outwardly and downwardly hooking flange extending along the side member, and an outwardly and upwardly hooking flange extending along the cross member or radial member. The flanges are hooked together for connecting the panel to the cross member or radial member. Additionally, the side member and the cross member or radial member each include a slit extending along the members below the flanges. Each slit opens into a tube-like groove extending along the members. When the side member and the cross members or radial members are hooked together, the slits are substantially aligned with each other such that the slits and grooves together form an elongated interlocking space having a dumbbell shaped cross section. A resilient interlocking seal strip, also having a dumbbell shaped cross section, is inserted into the interlocking space for sealing the side member, and thus the panel, to the cross member or radial member. The seal strip, thus inserted effectively locks, the panel to the cross member or radial member and prevents the panel from being unintentionally disconnected therefrom.

DESCRIPTION OF PREFERRED EMBODIMENTS

The cover of the present invention, and components for its construction, are described below in terms of preferred embodiments. The embodiments are constructed primarily from aluminum extrusions. It will be evident to those familiar with the pertinent art that a cover for a tank or other open-topped enclosure may be constructed from materials such as wood or steel, and assembled using traditional connections such as welds, screws or bolts. The cover of the present invention, however, is desired to be field erectable, at the location at which it is used, without the need for personnel having special skills. Because of this it is preferable that such a cover may be formed from lightweight components and assembled preferably without welds and with the minimum of bolted connections.

The cover is also desired to be resistant to atmospheric corrosion, and to corrosion by gases contained in a tank by the cover. Further, it is desired that the cover be easily configured to be adaptable to tanks in a range of different sizes and shapes, albeit generally rectangular or circular. It is for this reason that embodiments of the invention and components of the invention described below make maximum use of components which are readily extruded from aluminum.

Figure 1:
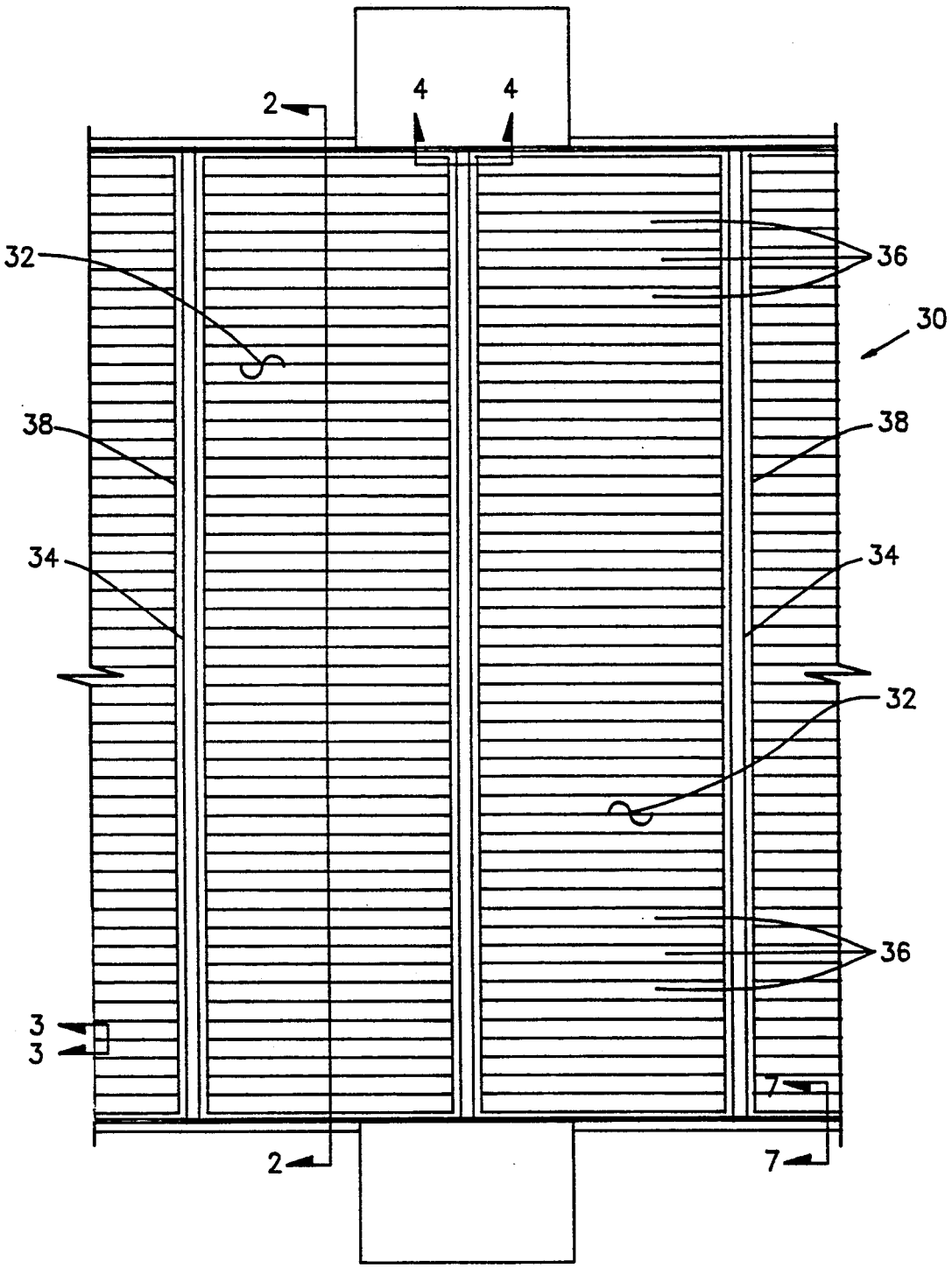
FIG. 1 schematically illustrates a fragmentary plan view of a rectangular cover in accordance with the present invention.

Turning now to the drawings, FIG. 1 shows a fragmentary plan view of a cover 30 in accordance with the principles of the present invention. The cover is generally rectangular and comprises a plurality of generally rectangular panels 32 arranged side-by-side to form the cover. Adjacent panels 32 are connected together by adjacent cross members 34. The panels are preferably connected to the cross members by a special form of sealable connection which is discussed in detail below.

Panels 32 are preferably constructed from a plurality of planks 36 arranged edge-to-edge and aligned along the length of the cover. Side members 38 are located along the edges of panels 32 extending across the width of all of the planks in the panel. Each of the side members 38 preferably include means for receiving the ends of the planks, such that the planks may be supported by the side members solely at their ends. Side members 38 preferably also include interconnecting means for connecting them, and thus the panels, to cross members 34, in such a way that a connection between a panel and a cross member may be substantially gas-tight.

Transverse support members 34 are preferably preformed such that planks 36 are supported entirely at their ends by side members 38, which in turn are connected to cross members 34. The weight of an assembled cover is carried essentially entirely by the support members. Because of this, panels 32 are not required to contribute substantially to the rigidity of a cover structure and thus are not required to be rigidly constructed. Panels 32 may be constructed in such a way that they are substantially gas-tight, but may be sufficiently flexible that they are free to assume the form of a section of an arch or a dome. Arches and domes are preferred shapes for a cover. A further advantage of a flexible panel is that it is free to absorb changes in shape which may be imposed by environmental factors such as wind loads or thermal expansion.

Figure 2:
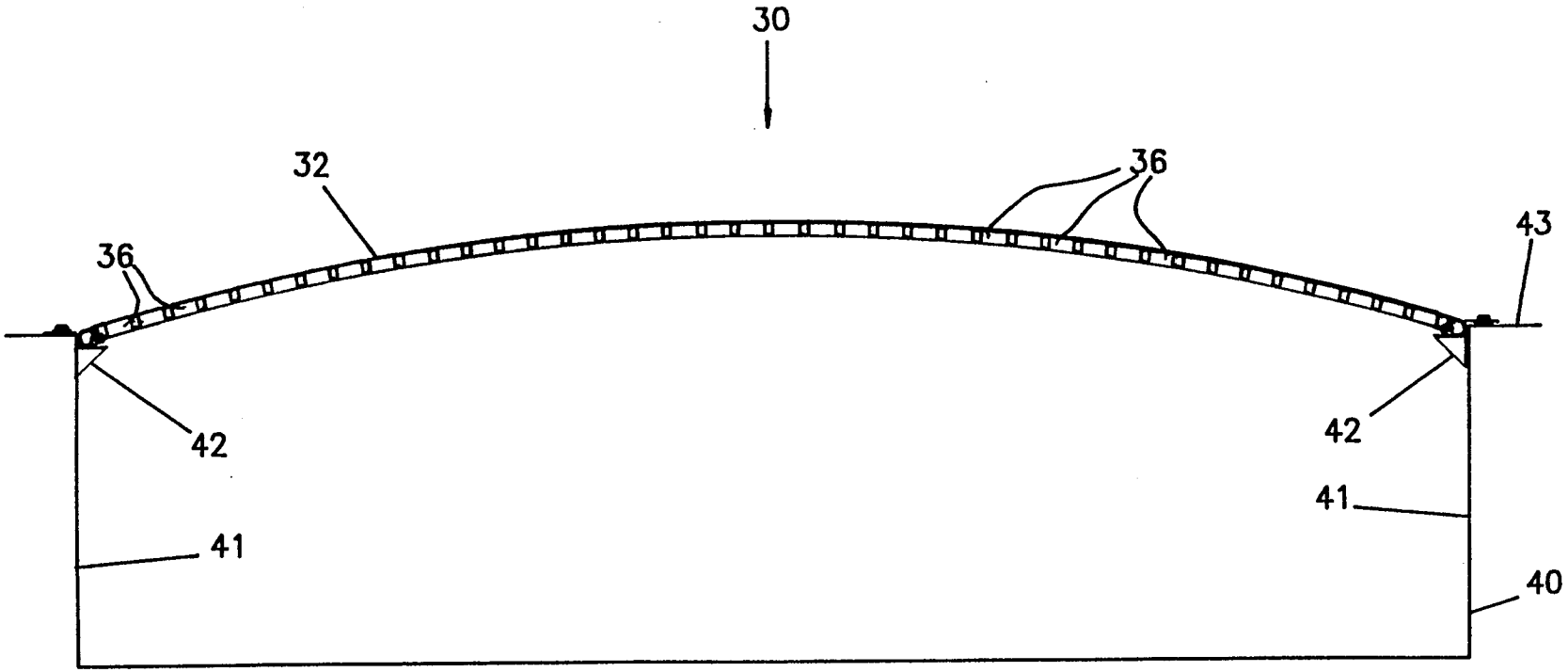
FIG. 2 is a cross-section view as seen generally in the direction 2—2 of FIG. 1.

In FIG. 2, the cover of FIG. 1 is shown in the form of an arch. It is shown in cross-section as seen generally along the line 2—2 of FIG. 1. The cover is supported on a tank 40 by a cover support arrangement 42 attached to the top thereof. An arch is an efficient structural form which allows a long distance to be spanned by a cover supported only at its extremities. An arch shape is preferably imparted to cover 30 by pre-forming cross members 34 and preferably side members 38 into an arcuate form. Planks 36 may be assembled into side members 38 to form semi-rigid panels 32 which assume the arch-like shape of the cover.

Figure 3A:
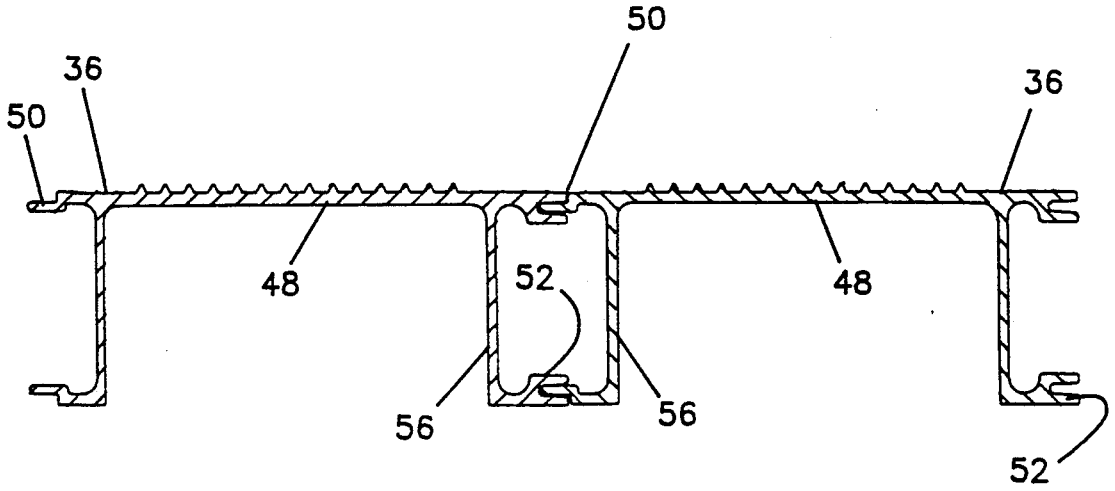
FIG. 3A schematically illustrates in cross-section a preferred form of planks for forming a cover in accordance with the present invention.
Figure 3B:
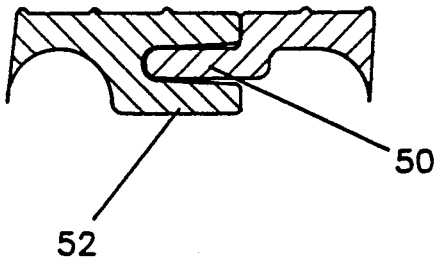
FIG. 3B schematically illustrates detail of a tongue-and-groove arrangement for interconnecting the planks of FIG. 3A.

Referring now to FIGS. 3A and 3B, details of a preferred form of planks 36 and a method of assembling them edge-to-edge is shown. Planks 36 are preferably formed from extruded aluminum and provided with a tongue-and-groove arrangement for connecting them together. Planks 36 include a flat, or deck portion 48 having along one edge thereof an outwardly extending protrusion or tongue 50 and along the other edge thereof an outwardly extending groove 52. Downwardly extending stiffening portions 56 impart a predetermined structural rigidity to the plank. The planks are assembled together edge-to-edge by inserting tongue 50 in groove 52 (see FIG. 3A), preferably without welds. Tongue 50 and groove 52 provide a firm, substantially gas-tight connection between planks 36, while providing a joint with sufficient flexibility that a multiplicity of the planks forming a panel is free to assume a slightly curved form.

It has been determined that a plank having a width of about four inches, and a depth of about two inches is convenient for forming covers having a span between about ten and fifty feet.

Figure 4A:
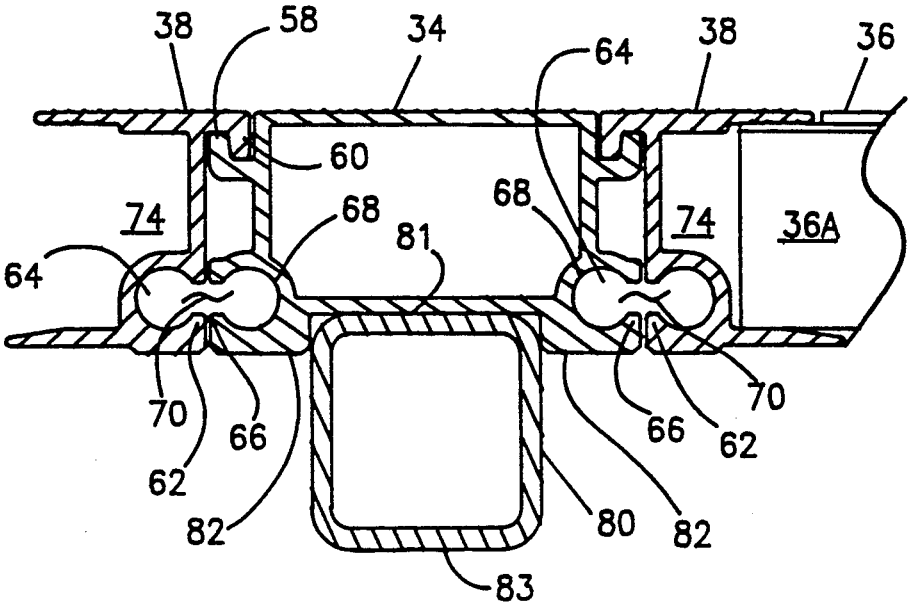
FIG. 4A is cross-section view seen generally in the direction 4—4 of FIG. 1 illustrating an interconnecting arrangement for panels and cross members of the cover of FIG. 1
Figure 4B:
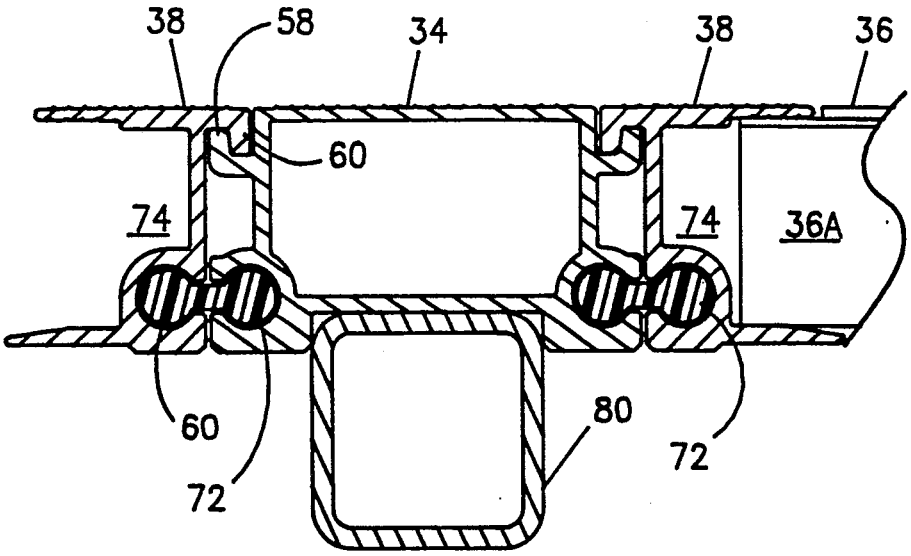
FIG. 4B shows the view of FIG. 4A including an interlocking seal strip for sealing a panel to a cross member.

In FIG. 4A and FIG. 4B is shown a cross-section view of a preferred form of cross members 34 and side members 38 as seen generally along the line 4—4 of FIG. 1. Here, transverse cross member 34, preferably formed from extruded aluminum, includes, on each side thereof, an outwardly and upwardly hooking flange 58. Side member 38 includes an outwardly and downwardly hooking flange 60. Flanges 58 and 60 are hooked together for connecting the side member, and thus panel 32, to cross member 34.

Below flange 60 on side member 38 is a slit 62 extending along the length of the side member. Slit 62 opens into a tunnel-shaped groove 64 also extending along the length of the side member. Similarly, cross member 34 has a slit 66 extending along the length of the support member below flange 58. Slit 66 opens into a tunnel-like groove 68 extending along the cross member. When flanges 58 and 60 are hooked together, slits 62 and 66 are substantially aligned with each other such that the slits and grooves together form an interlocking space 70, having a dumbbell or "dog-bone" type cross section.

An interlocking seal-strip 72 of a resilient plastic material such as ELVAX 670, available from DuPont of Wilmington, Del., and also having a dumbbell-shaped cross-section, is inserted into interlocking space 70, to form a substantially gas-tight seal between side member 38 and cross member 34. When seal-strip 72 is inserted unto space 70 (see FIG. 4B), it also prevents flanges 58 and 60 from being unhooked, and thus prevents side member 38 and thus panel 32 from being unintentionally disconnected from cross member 34. Panel 32 may, of course, be intentionally disconnected, for example, by withdrawing seal-strip 72 from interlocking space 70 and unhooking flanges 58 and 60.

It should be noted that while panel 32 and cross member 34 may be described as substantially locked together by seal-strip 72, some degree of relative movement of the side member on the cross member is possible. This allows the panels and support members to be configured into the curvature of a shallow-arch, as illustrated in FIG. 2, and, as will be discussed further below, into the shape of a dome.

Side member 38 includes a channel 74 for receiving the ends 36A of planks 36. Channel dimensions are selected such that a firm substantially gas-tight fit may be obtained between planks and side members, while allowing a sufficient degree of flexibility between them that a cover may conform to a shallow curvature.

As described above, planks 36 may be dimensioned such that one extrusion section is applicable to covers having different spans. Similarly it is preferable, to dimension side members 38 and cross members 34 such that they are usable in a wide range of cover sizes. This is not a problem for a side members 38, as they are not required to bear a structural load and may be of only one form for wide range of cover sizes. Cross members 34, however, are required to bear a structural load which increases as the size of a cover increases.

Continuing with reference to FIG. 4A, one means of standardizing a size for a cross members 34 is to dimension the member, such that, alone, it is adequate to support the smallest span envisaged, and, for larger spans, to provide the necessary rigidity by attaching a stiffening member 80 to surface 81 of cross member 34.

It has been found convenient for cross member 34 to have an overall width of about 3.5 inches and an overall depth of about 2.5 inches. As shown in FIG. 4A, stiffening member 80 may be of standard square section tubing about 1.75 inches in diameter. Stiffer stiffening members may be made, for example from larger section tubing attached to surfaces 82 of cross member 34, by attaching deeper section tubing to surface 81, or by adding additional tubing to surface 83 of stiffening member 80.

Figure 5:
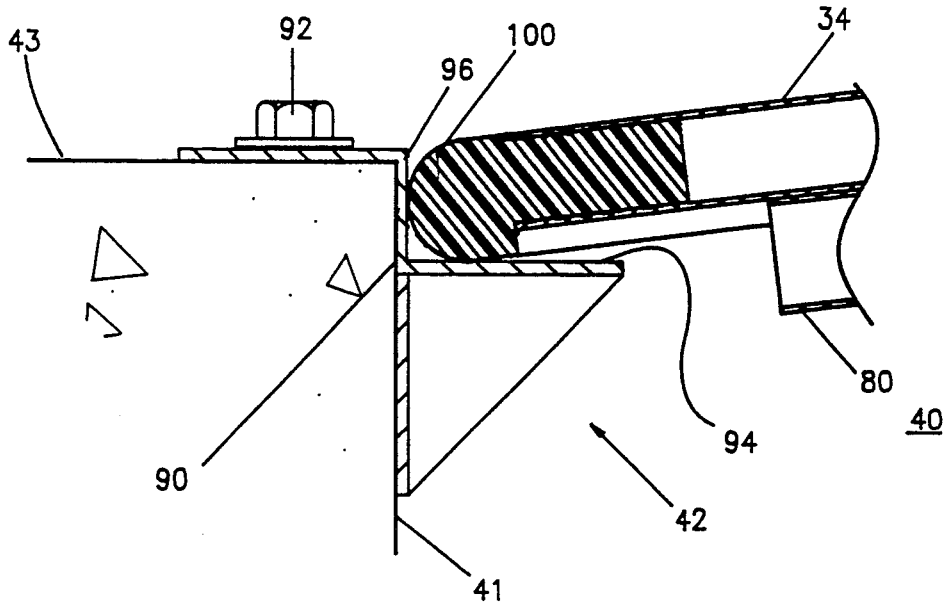
FIG. 5 is a cross-section view schematically illustrating one embodiment of a cover support arrangement for the cover of FIG. 1.

Continuing now with a description of a cover support arrangement for supporting cover 30 on a tank, FIG. 5 shows details of arrangement 42 (see also FIG. 2) for supporting the cover on an inside wall 41 of tank 40. The cover support arrangement 42 comprises a bracket 90 extending along the length of the tank and attached thereto at intervals by bolts 92. Although not shown in FIG. 5, it will be evident that at least two brackets 90 are required. One on each of two opposite sides of tank 40.

Bracket 90 includes a generally horizontal support member 94 for supporting the cross members and a vertical restraining member 96. Together, the vertical and horizontal members of bracket 90 form an inwardly facing L-shaped bracket for receiving cross members 34. Preferably the ends of cross members 34 include means for proving a slidable engagement with horizontal support member 94. This serves to permit movement of the cross members for accommodating changes in shape of cover 30 due to environmental and other loads. Preferably a seal is also provided between cross member 34 and support arrangement 42. In one embodiment, a slidable engagement and a seal may be provided by inserting in an end of a cross member a rounded block 100 of a resilient material such as DELRIN available from DuPont of Wilmington, Del. Such a material is sufficiently resilient and also has a sufficiently low coefficient of friction that it may slide on member 94 while still providing an effective seal at the point of contact. It should be noted that stiffening member 80 is terminated short of the end of cross member 34. By thus terminating stiffening member 80, or any other stiffening member or members, only one size of support arrangement is necessary to accommodate a variety of cover sizes.

Figure 6:
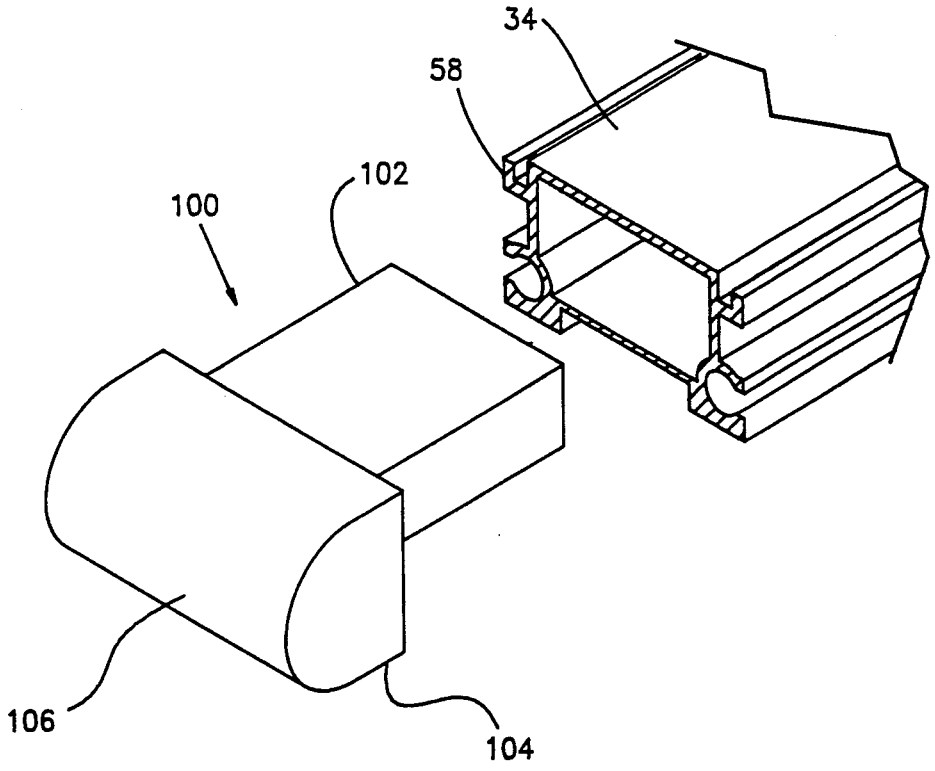
FIG. 6 is an exploded view schematically illustrating an end block for a cross member of the cover of FIG. 1.

In FIG. 6 is illustrated a preferred form of block 100. Here, block 100 includes a plug portion 102 having dimensions sufficient to provide a firm fit in an end of a cross member 34, and a contact portion 104 having a rectangular overall dimension, preferably sufficient completely cover an end of cross member 34. Contact portion 106 has a rounded surface 106 for providing slidable contact with horizontal support member 94.

Figure 7A:
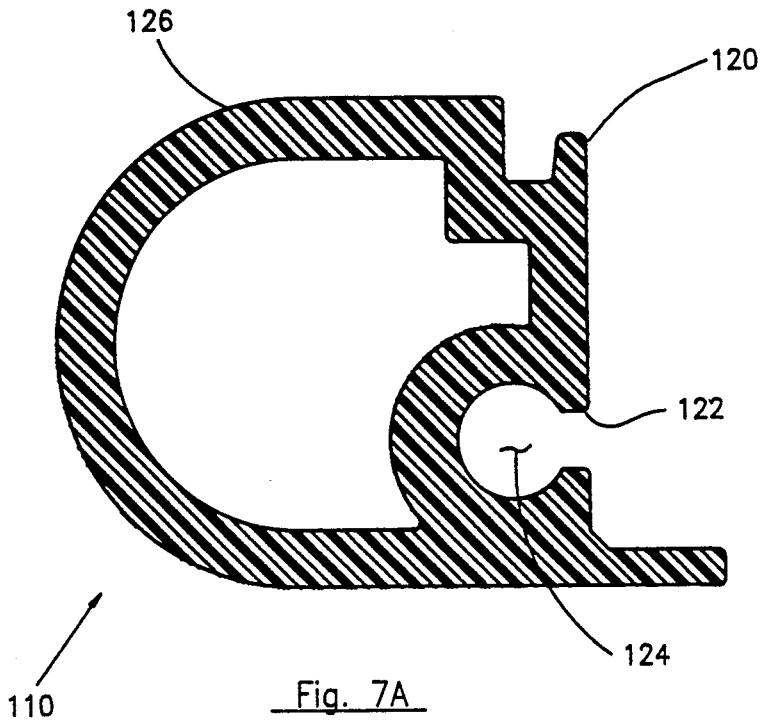
FIG. 7A is a general cross-section view of a sealing member for a panel of the cover of FIG. 1.
Figure 7B:
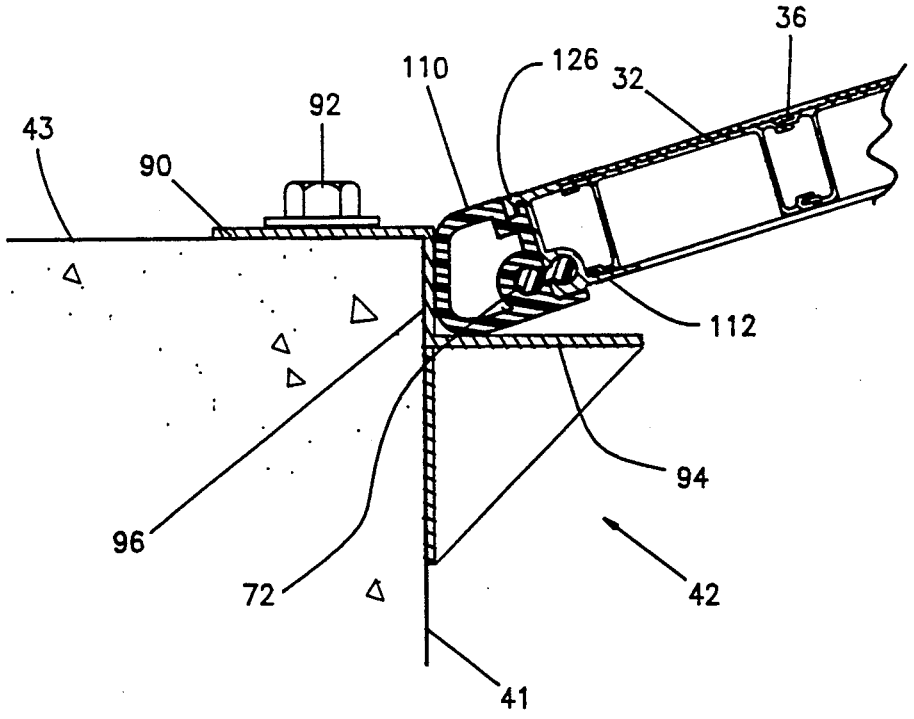
FIG. 7B is a cross-section view seen in the direction 7—7 of FIG. 1 schematically illustrating the sealing member of FIG. 7A attached to a panel in contact with the cover support arrangement of FIG. 5.

In FIGS. 7A and 7B is shown a method of sealing the ends of panels 32 with support arrangement 42. A sealing member 110 is illustrated in cross-section in FIG. 7A. The sealing member may be formed by a hollow extruded section of a plastic material such as RMPVC available from Fabricated Extrusions Company of Modesto, Calif. Sealing member 110 is configured to be attached to a boundary member, or terminating member, 112 (see FIG. 7B), which is attached to an end one of planks 36 in a panel 32. It includes an upwardly hooking flange 120 extending along the length of the member, and below the flange, a slit 122 opens into a tunnel-shaped groove 124. A rounded portion 126 is provided for forming a seal.

Continuing with reference to FIG. 7B, boundary member 112 is preferably made of the same extrusion as side members 38 of FIG. 4B), in the interest of reducing the number of different extrusions required to form a cover. The boundary member 112 thus includes an outwardly and downwardly hooking flange 126, and sealing member 110 is connected to boundary member 112 by hooking together flanges 120 and 126. Boundary member 112 also includes a slit which opens into a tunnel shaped groove (not identified by numerals but visible in FIG. 7B). The slit is aligned with slit 122 of sealing member 110, to provide a dumbbell shaped interlocking space (not visible in FIG. 7B but similar to interlocking space 70 of FIG. 4B). A sealing strip 72 inserted in the interlocking space provides a substantially gas-tight seal between boundary member 112 and sealing member 110 and prevents them from being unintentionally disconnected. When cover 30 is supported on horizontal support member 94 sealing member 110 is compressed against horizontal support member 94 of bracket 90 and vertical restraining member 96 (see FIG. 7B) to form a substantially gas-tight seal between a panel and the tank.

Figure 8:
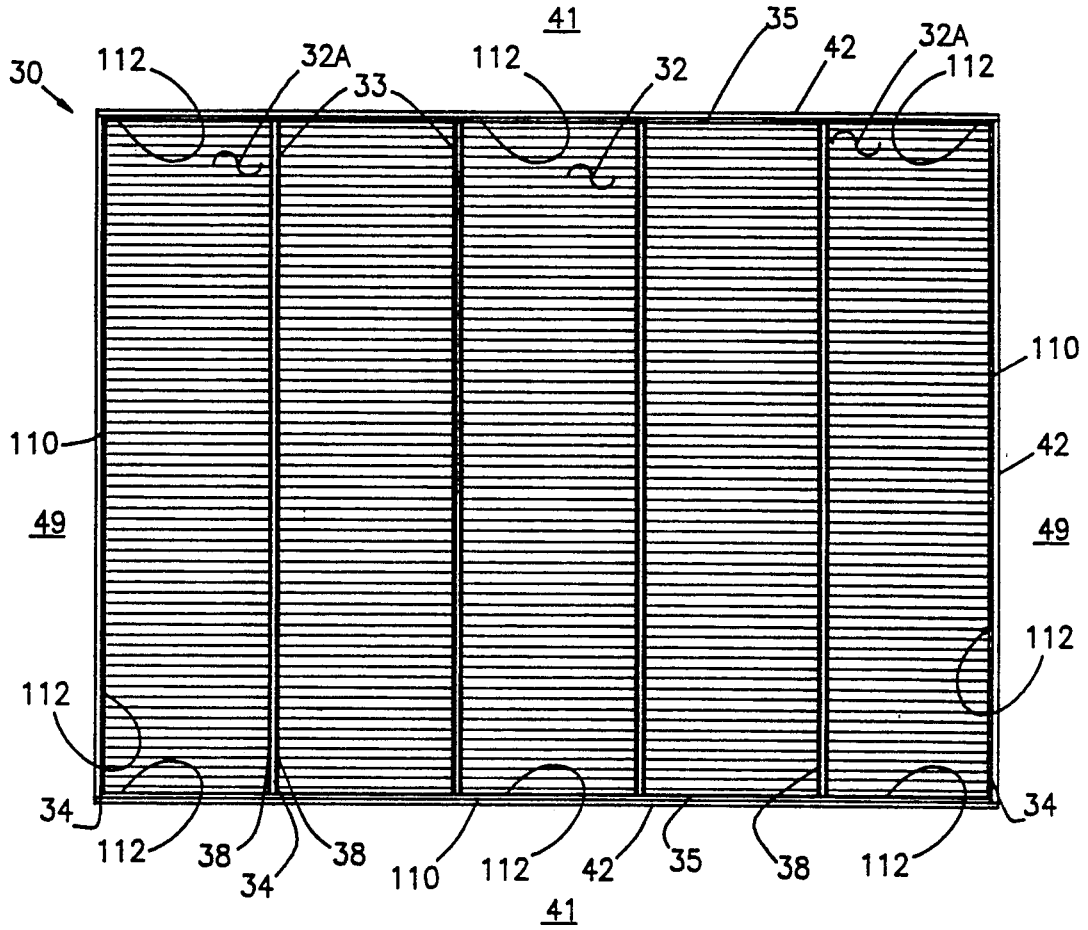
FIG. 8 is a plan view schematically illustrating the cover of FIG. 1 including two end-panels.
Figure 9:
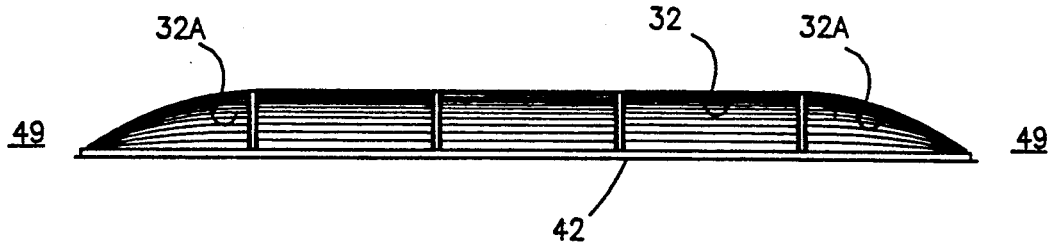
FIG. 9 is a side elevation view schematically illustrating curvature of the end panels of FIG. 8.

FIG. 8 and FIG. 9 show a method of completing the ends of rectangular cover 30. Here, cover 30 includes three panels 32, and two panels 32A which may be referred to as end panels. The cover has the shape of an arch having a rectangular periphery. All of the panels of the cover have a side member 38 attached to at least one of two generally parallel straight sides 33. In such an arrangement panels 32 would include a side member along each of generally parallel, straight sides 33, and a boundary member along each of ends 35, the side and boundary members attached to cross members and sealing members respectively, as described above. End panels 32A, have a side member 38 attached to only one of the straight sides and are attached to an end one of cross members 34. On the opposite straight sides and on both ends of panels 32A is attached a boundary member 112 having a sealing member attached thereto as described above.

A rectangular tank to be covered may be provided with a cover support arrangement 42 as illustrated in FIG. 7B. The cover support arrangement is located along two opposite sides 41 of the tank, and with a similar arrangement along two opposite ends 49 of the tank, thus providing a generally rectangular cover support arrangement. Sealing members 110 on panels 32 and 32A, and end blocks 100 (see FIG. 5) on the ends of cross members 34, together form a substantially gas-tight seal between cover 30 and tank 40.

In FIG. 9 the height of cover 30 is exaggerated for purposes of illustration. In practice, an arched cover preferably has a ratio of width (span) to height at the vertex of about 20:1 or greater. Such a shallow arch provides minimum gas volume under the cover, consistent with still retaining an arch-like shape sufficient for structural efficiency. The curvature of end panels 32A, in practice, is thus significantly less than is illustrated in FIG. 9.

By way of example, an arch having a width or span of about seventeen feet may have a vertex height between about six and twelve inches. Because of this, and because of the freedom of compliance of planks and panels, pursuant to the above-described construction, end panels 32A may acquire a curved shape within the confines of a rectangular cover support and seal arrangement, without the need to pre-form planks into the curved shape.

Figure 10:
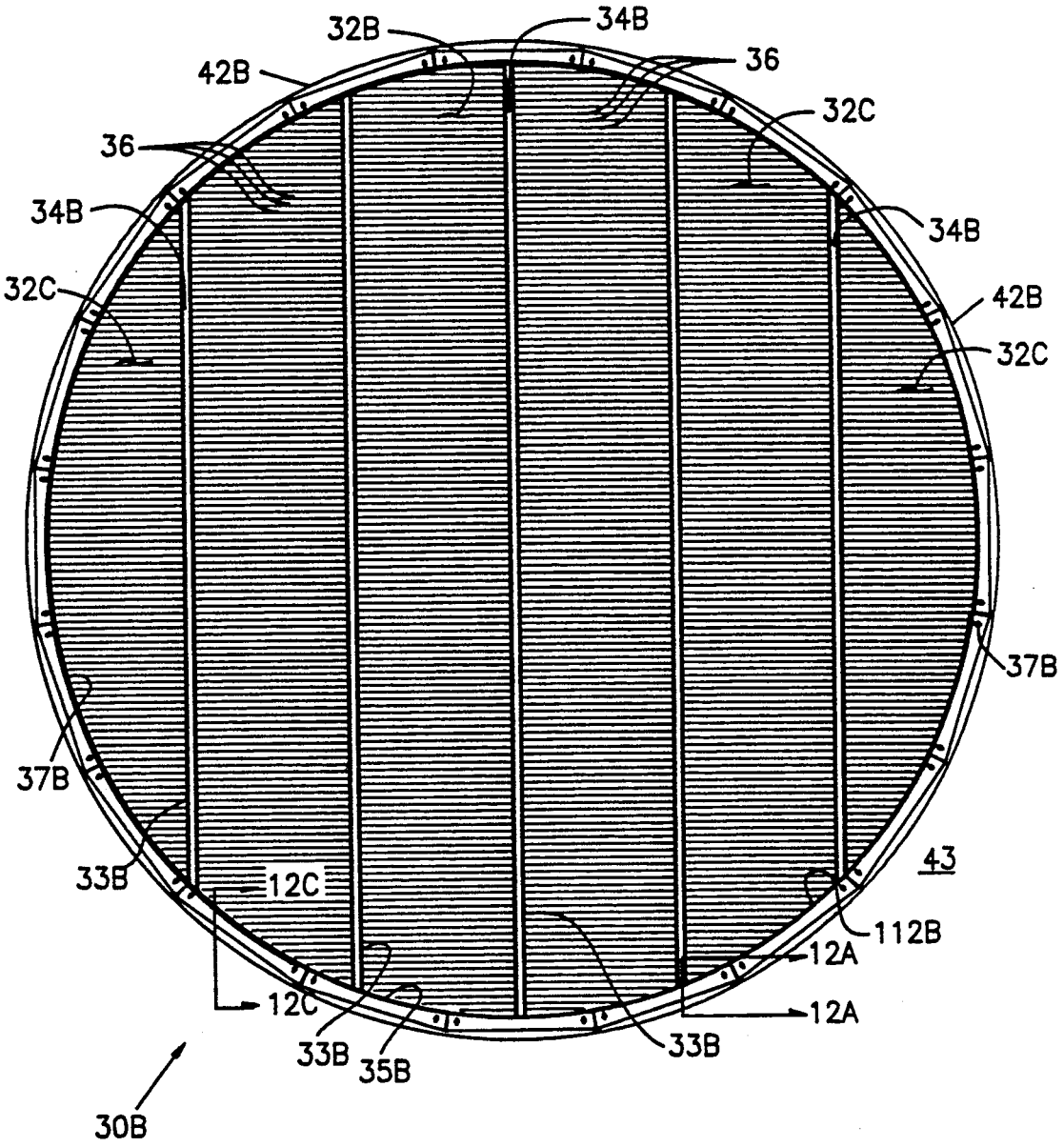
FIG. 10 is a plan view schematically illustrating a dome shaped cover in accordance with the present invention.
Figure 11:
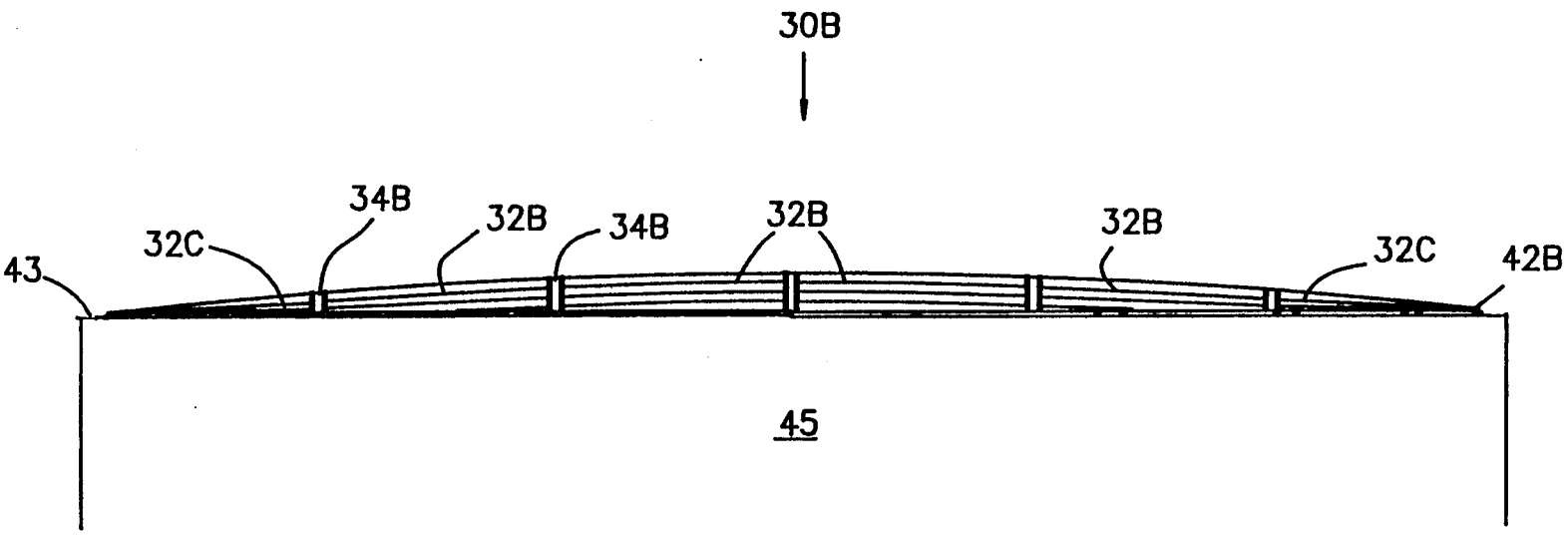
FIG. 11 is an elevation view of the cover of FIG. 10.

Continuing now with a description of preferred embodiments of the present invention, a cover 30B, having the form of a shallow dome, is illustrated in FIG. 10 and FIG. 11. Such a dome may have a diameter to height ratio of about 20:1 or less. Referring in particular to FIG. 10, such a dome may be constructed, from panels 32B and 32C each having the form of a section of a circle having about the same diameter as the dome. Panels 32B have two generally parallel straight sides 33B and two curved ends 35B. When the cover is assembled the covered ends of the panels lie generally on a circle having about the same diameter as the dome.

End panels 32C each include a straight side 33B and a curved side 37B, the ends of panels 32C being essentially pointed. Panels 32B and 32C are preferably constructed of edge-to-edge planks 36 as described above, and are arranged together side-by-side and connected together by cross members 34B. Panels 32C are each connected to an end of one the cross members. Panels 32B have a side member 38 on each straight side and panels 32C have a side member on straight side 33B. Cross members 34B and side members connected thereto, are similar in construction to cross members 34 and side members 38 of rectangular cover 30 (see FIGS. 4A and 4B), with the exception that each has a particular arcuate form such that the arrangement of panels and cross members forms a cover having the shape of a dome.

End members 112B (attached to each of curved ends 35B and to curved sides 37C) have sealing members 110 attached thereto (not visible in FIG. 10). They are preferably arranged as illustrated in FIGS. 7A and B, with the exception that end members 112B are curved such that sealing members fall on a circle having about the same diameter as the diameter of the dome. The method of attaching and sealing panels 32B and 32C to cross members 34B is preferably as described above for panels 32 and cross members 34.

A preferred cover support and seal arrangement 42B for cover 30B is illustrated in FIGS. 12A, 12B, 12C, and 13. In arrangement 42B, a plate 150 is attached by one or more bolts 92 to the top 43 of a circular tank 45. Plate 150 provides a horizontal support member and an angle section 152 attached thereto forms a vertical restraining member 154. The plate and the angle section together define an inward facing circular U-shaped channel or bracket 158, encircling tank 45 for receiving cross members 34B. Cross member 34B includes an end block 100B for providing slidable engagement and a substantially gas-tight seal with channel 158. Block 100B is similar in construction to block 110 (see FIGS. 6) with the exception that, as illustrated in plan view only in FIG. 12B, curved portion 106B thereof is preferably curved to conform to the curvature of channel 158.

Figure 12A:
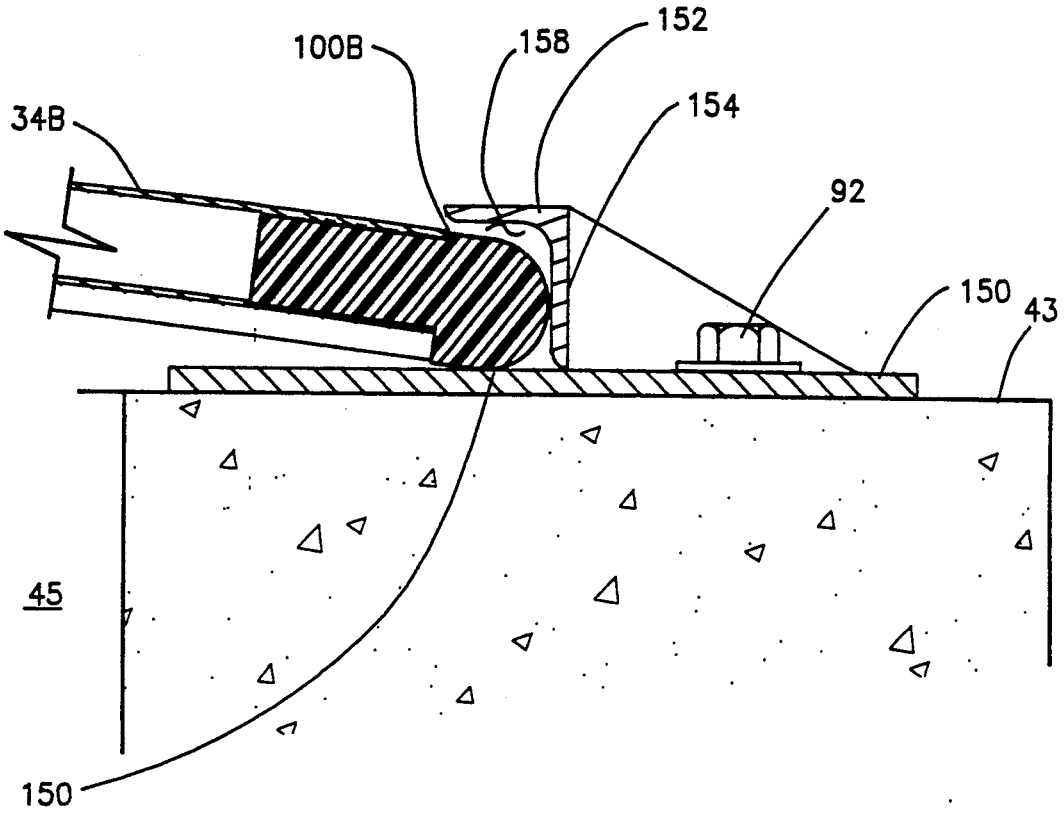
FIG. 12A is a cross section view seen generally in the direction 12A—12A of FIG. 10 schematically illustrating a cover support arrangement for the dome-shaped cover of FIG. 10.
Figure 12B:
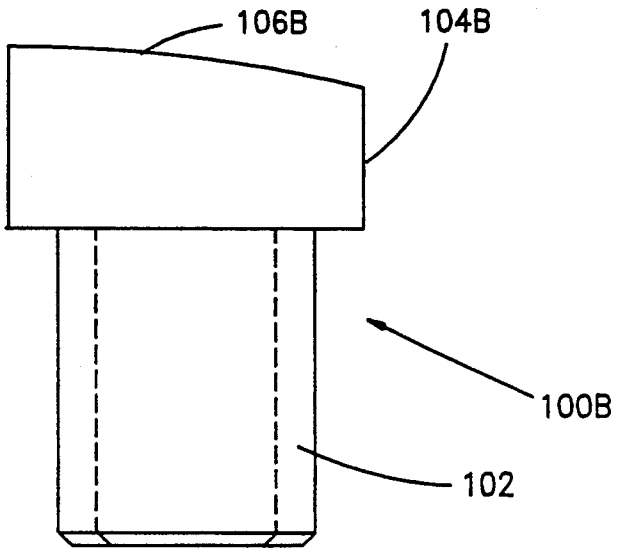
FIG. 12B is a plan view schematically illustrating an end block for a cross member of the cover of FIG. 10.
Figure 12C:
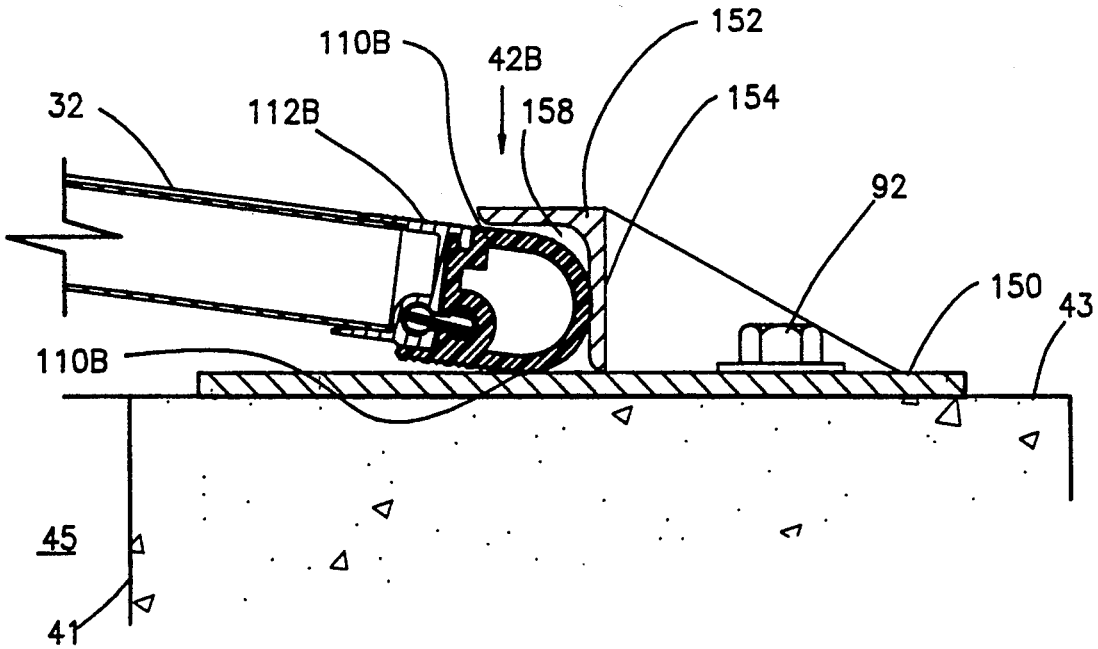
FIG. 12C is a cross-section view seen generally in the direction 12C—12C of FIG. 10 schematically illustrating a sealing arrangement for a panel of the cover of FIG. 10.

In FIG. 12C is shown the arrangement of a panel end member 112B and a sealing member 110B received by channel 158. The method of attaching an end member to a panel and a sealing member to an end member is similar to the method described above for rectangular cover 30.

Figure 13:
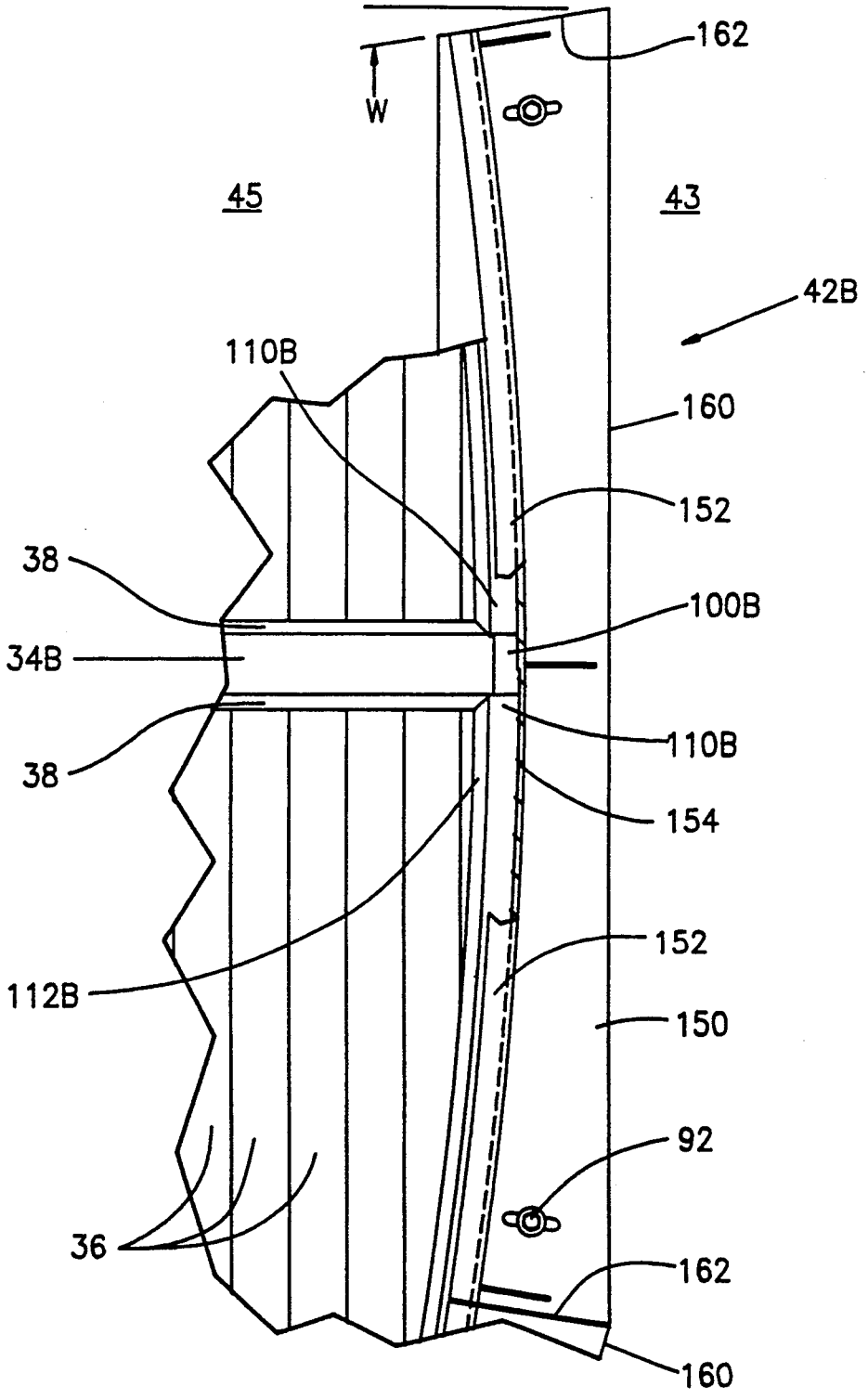
FIG. 13 is a fragmentary plan view schematically illustrating a portion of the cover support arrangement of FIG. 12A and the panel sealing arrangement of FIG. 12C.

It will be appreciated that constructing cover support arrangement 42B as a single circular component is somewhat impractical, particularly for a tank cover which has a diameter of about fifty feet. Accordingly, it is preferable that the cover support arrangement is assembled into a circular form on site from components. FIG. 13 illustrates one of twenty units 160 which may be assembled to form circular cover support arrangement 42B. Units 160 have ends 162 inclined at an angle W of about nine degrees from square. Angle section 152, in the form of a shallow arc, is shown cut away in a central portion to show the arrangement of sealing members 110B and end blocks 100B in inwardly facing U-shaped channel 158.

While the use of a circular inwardly facing U-shaped channel has been described as a means for supporting dome-shaped cover 30B, it will be evident that a straight form of such a channel, extending along at least two opposite sides of a rectangular tank, may be used for supporting a rectangular arch-shaped cover. Similarly, the inwardly facing L-shaped bracket of FIG. 7B may equally well be used to arranged in a circular form to support a dome-shaped cover.

Figure 14A:
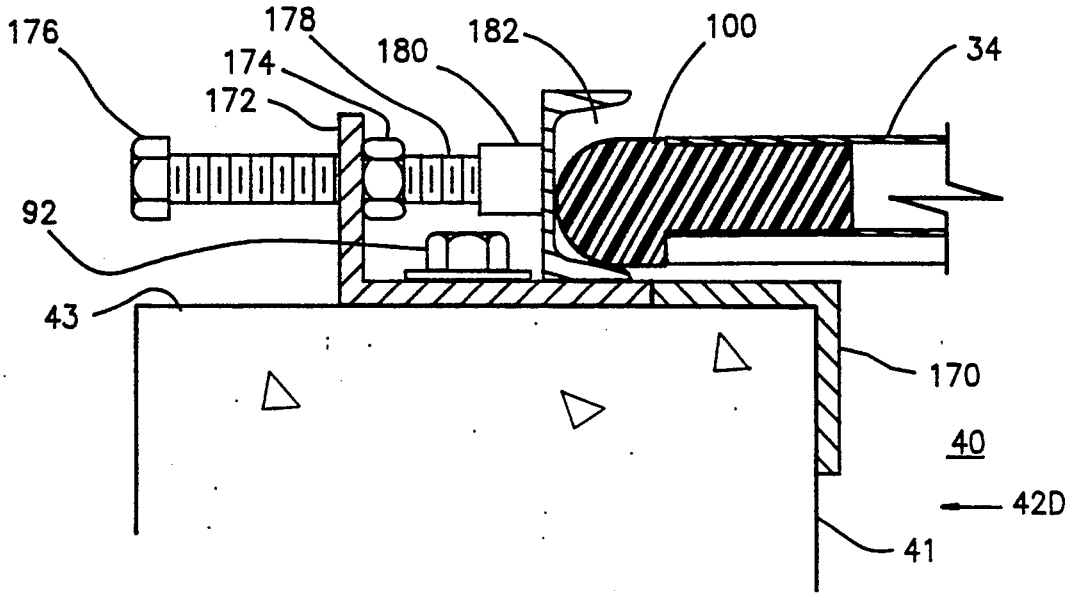
FIGS. 14A and 14B are cross section views schematically illustrating another embodiment of a cover support means for a rectangular cover according to the present invention.
Figure 14B:
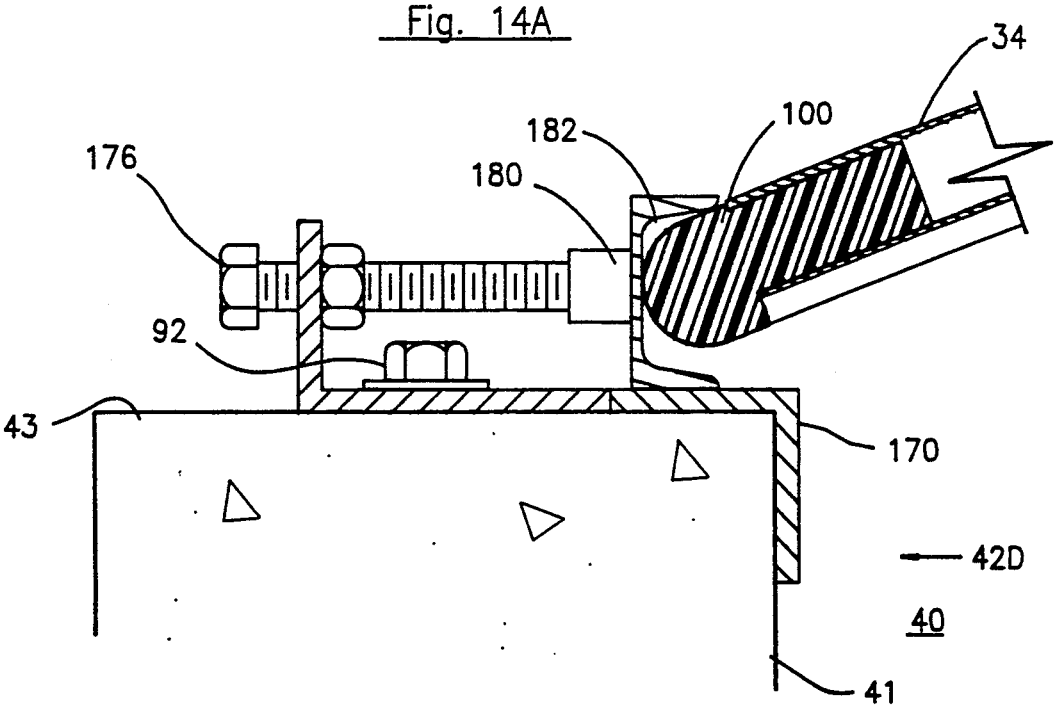

In FIGS. 14A and 14B, for example, is illustrated a particular form of cover support arrangement 42D which may be used to form an arch-shaped cover from an assembly of panels and cross members, wherein the cross members are, initially straight rather than preformed into an arcuate shape. In the arrangement of 42D, end block 100 of cross member 34 engages an inwardly facing U-shaped channel section 182. Channel 182 extends along the length of the tank for receiving cross members 34 and sealing members 110. Initially, cross member 34 is straight (see FIG. 14A). Channel 182 is free to slide on a bracket 170 which is attached by one or more bolts 92 to the top 43 of a rectangular tank. The bracket 170 includes a vertical member 172 having a nut 174 attached thereto. A bolt 176 has a threaded portion 178 extending through nut 174, and includes a bearing block 180 for engaging channel 182. Bolt 176 is one of a plurality of such bolts, preferably arranged for contacting the end of each cross member in a cover. A similar support arrangement (not shown) is located on an opposite side of the tank.

As bolts 176 are tightened, a compressive force is applied to each end of the cross members forcing the cross members to flex upward (see FIG. 14B) and assume an arcuate form. The cross members are preferably encouraged to flex in an upward direction, for example, by initially applying a lifting force with a crane or hoist attached at about the center of the cover. As already described, the assembly method for planks in the panels forming the cover, allows the panels to assume the same arcuate form as the cross members.

Continuing now with a discussion of dome shaped covers, a method of constructing a cover having a relatively deep domed shape will be described. Such a cover, for example, may have a ratio of height to diameter of about 5:1.

Figure 15:
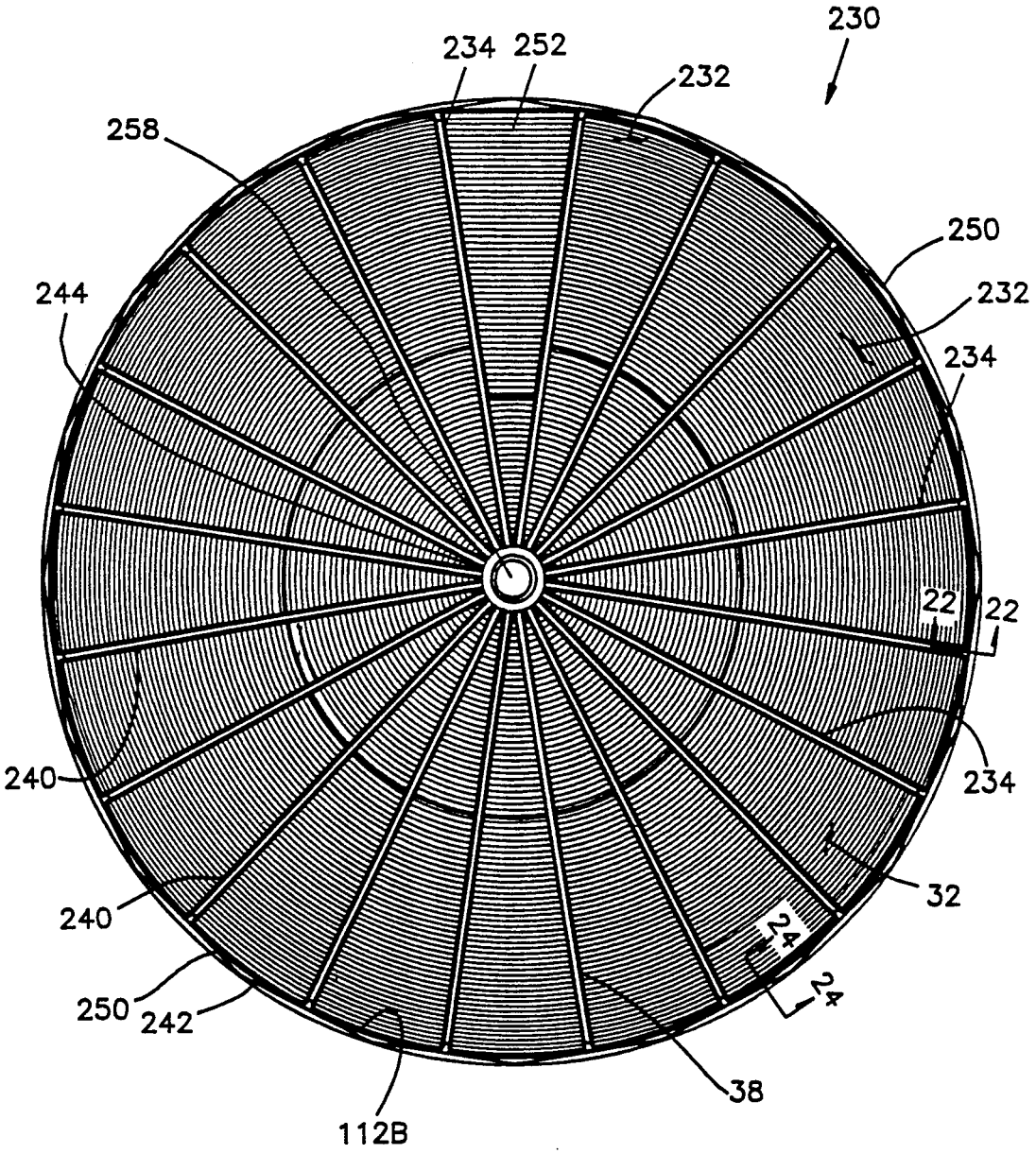
FIG. 15 is a plan view schematically illustrating another embodiment of a dome-shaped cover in accordance with the present invention.
Figure 16:
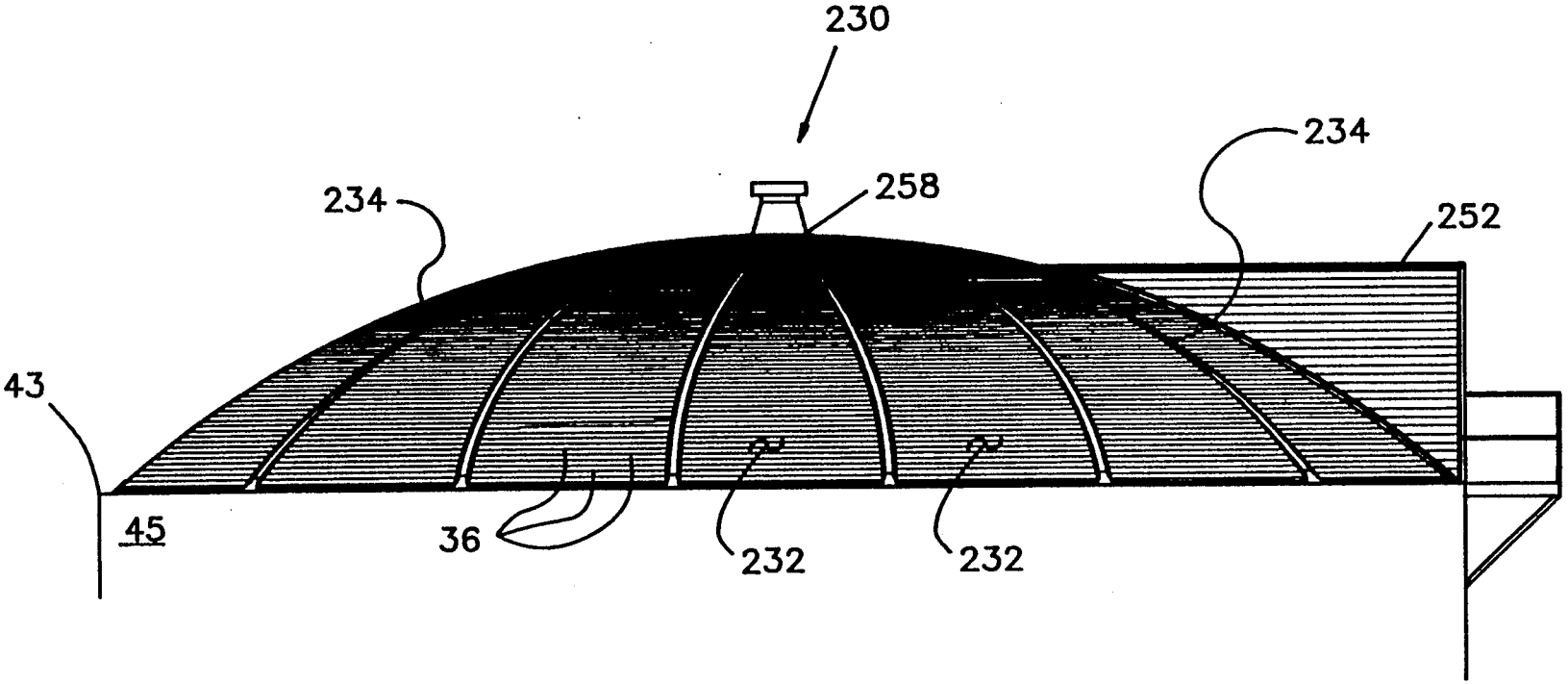
FIG. 16 is an elevation view schematically illustrating the dome-shaped cover of FIG. 15.

One preferred form of deep domed cover is illustrated in FIG. 15 and FIG. 16. Here, dome-shaped cover 230 includes a plurality of panels 232, each generally having the shape of a segment of a circle having about the same diameter as the dome, and a plurality of arcuate radial members 234. Panels 232 and radial members 234 are arranged alternately in a radial pattern (see FIG. 15) with a panel located between each pair of adjacent radial members and attached thereto. A dormer or inspection hatch 252 may be provided in one of the panels, for example, for tank maintenance purposes.

Each panel 232 has two straight sides 240, a base 242 and an apex 244. The panels are preferably constructed of edge-to-edge planks 36 as described above for covers 30 and 30B. Panels 232 include a side member 38 on each of the straight sides and a boundary member 112B on the base and at the apex. Preferably, the radial members and side members are configured as described above (see FIGS. 4A and 4B) and have a similar interlocking and sealing arrangement, including a dumbbell-shaped interlocking and seal strip 72.

Continuing with reference to FIGS. 15 and 16, radial members 234 engage, at one end thereof, a compression unit 258, located at the center of the radial pattern of radial members and panels. At their other end, radial members 234 engage a cover support means or tension ring 250 attached to and encircling the top 43 of tank 45.

Figure 17A:
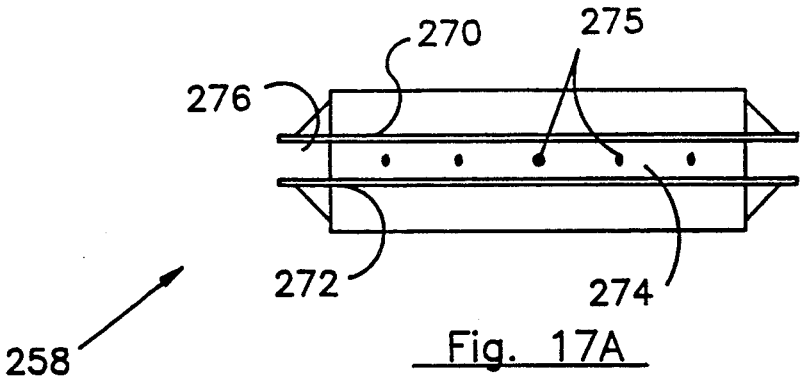
FIG. 17A is an elevation view schematically illustrating a compression unit for the dome-shaped cover of FIG. 15.
Figure 17B:
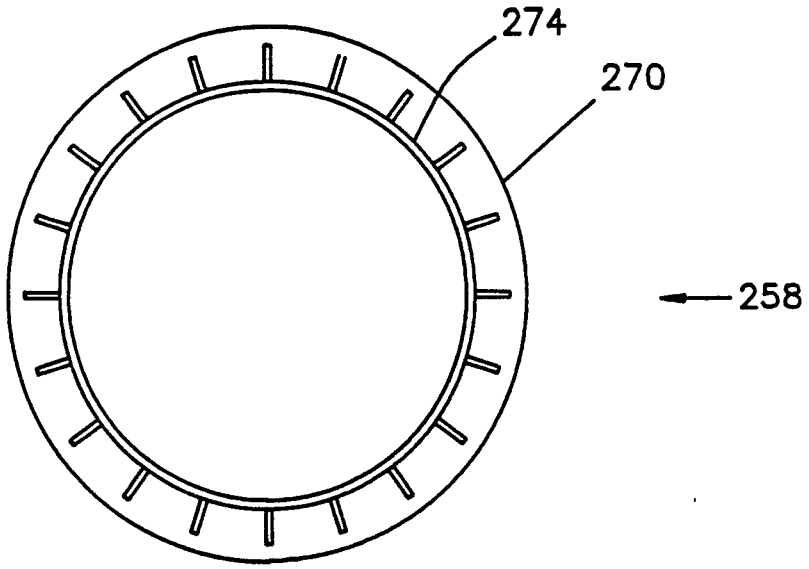
FIG. 17B is a plan view schematically illustrating the compression unit of FIG. 17A.
Figure 17C:
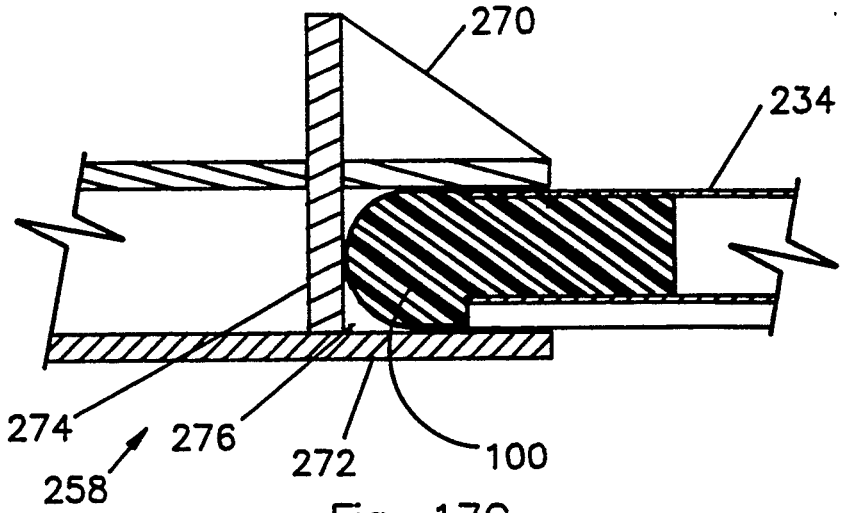
FIG. 17C is a cross-section view illustrating engagement of a radial member of the cover of FIG. 15 in the compression unit of FIG. 17A.
Figure 18:
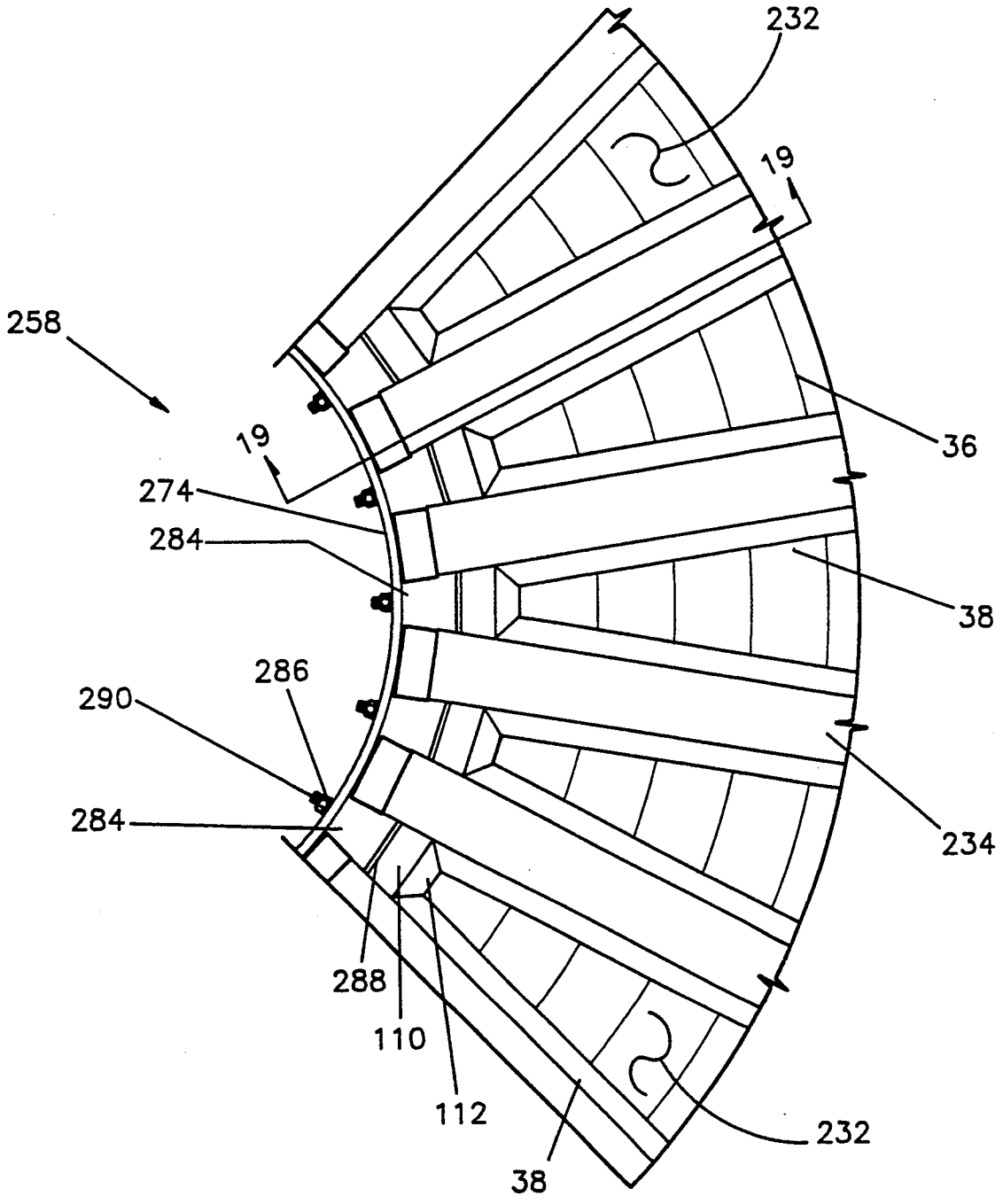
FIG. 18 is a fragmentary plan view schematically illustrating clamping arrangement for a radial member in a sealing arrangement for panels of the dome-shaped cover of FIG. 15.
Figure 19:
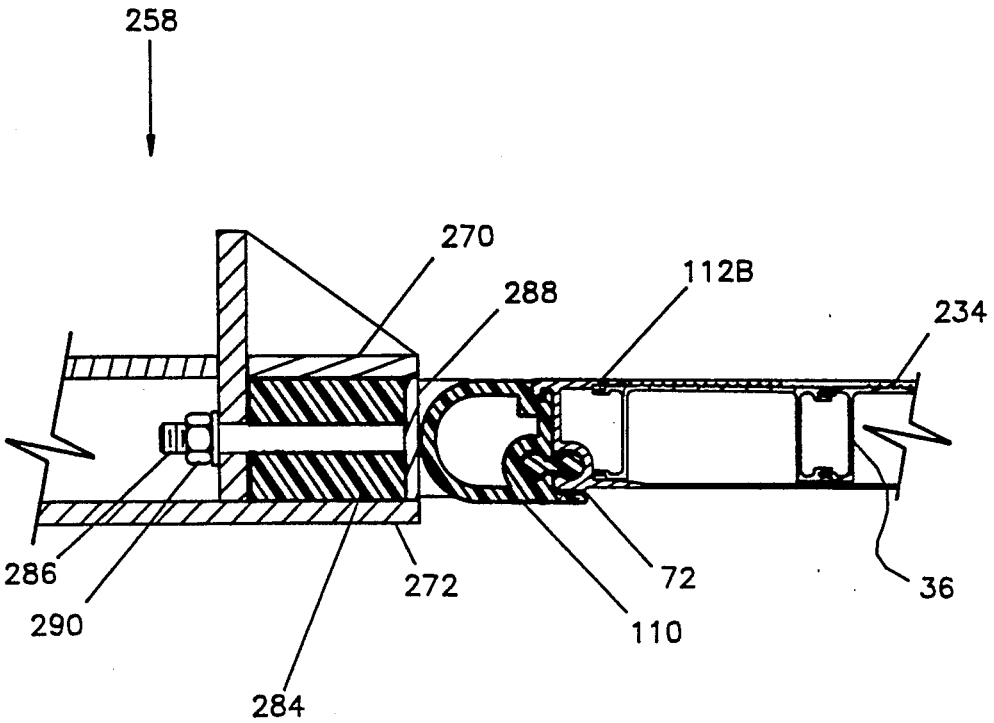
FIG. 19 is a cross section view seen generally in the direction 19—19 of FIG. 18, further illustrating a sealing arrangement for panels.

Referring now to FIGS. 17A, 17B, and 17C, one preferred form of compression unit 258 includes upper and lower annular portions 270 and 272 respectively, attached around a compression ring 274 to form an outward-facing channel 276 for receiving the ends of radial members 234. Referring now to FIG. 18, preferably, an end block 110, similar to the above-described end blocks for cross members 34 (see FIG. 6C) provides slidable engagement of a radial member 234 with channel 276 (see FIG. 17C), and provides a substantially gas-tight seal between the radial member and the compression ring.

Figure 21A:
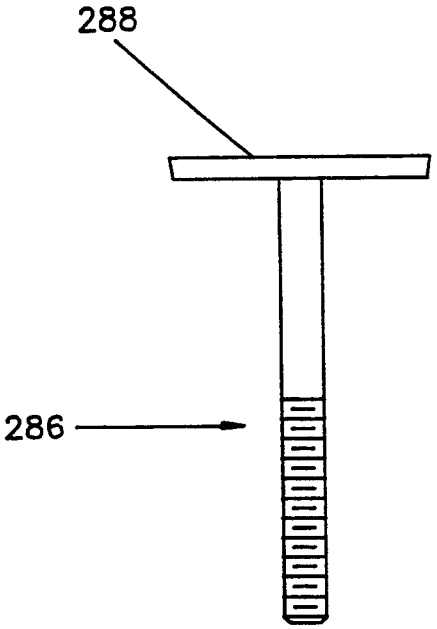
FIGS. 21A and 21B are elevation views schematically illustrating a bolt including a compression plate for the block of FIGS. 20A and 20B.
Figure 21B:
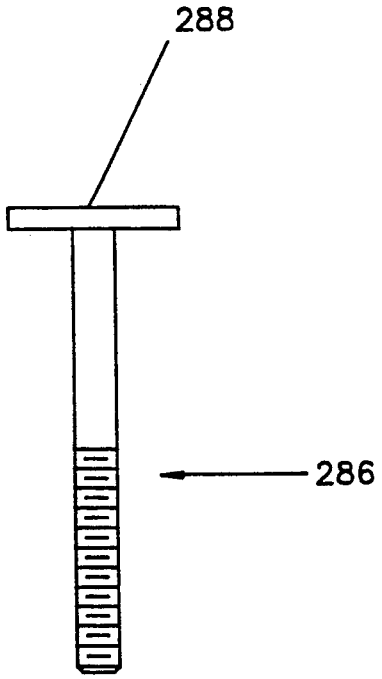

FIG. 18, FIG. 19, and FIGS. 20A and 20B show a method of clamping radial members 234 to compression unit 258. Between each pair of radial members 234 is located a clamping block 284 of a resilient material, preferably rubber. Clamping blocks 284 have a wedge shape including a narrow end 283 and a wide end 285 (see FIGS. 20A and 20B) and have a hole 287 through which is inserted a bolt 286. The block 284 is assembled on the compression ring with the narrow end against the compression ring. A threaded end of the bolt is passed through a hole 275 in compression ring 274 (see FIG. 17A) where it may be secured with a nut 290 inside of the ring (see FIG. 18). Referring to FIGS. 21A and 21B, bolt 286 has a head 288 in the form of a rectangular plate having about the same dimensions as wide end 285 of clamping block 284.

When a cover 230 is assembled, all of clamping blocks 284 are first assembled loosely on compression ring 274. radial members 234 are placed in position between adjacent pairs of the blocks and the nuts 290 are loosely tightened.

After panels 232 have been attached to radial members 234, the nuts are progressively tightened, preferably all with about the same torque. Tightening the bolts compresses clamping blocks 284, and, clamps radial members 234 to compression unit 258, while at the same time effectively and automatically providing even spacing around the unit.

Figure 22:
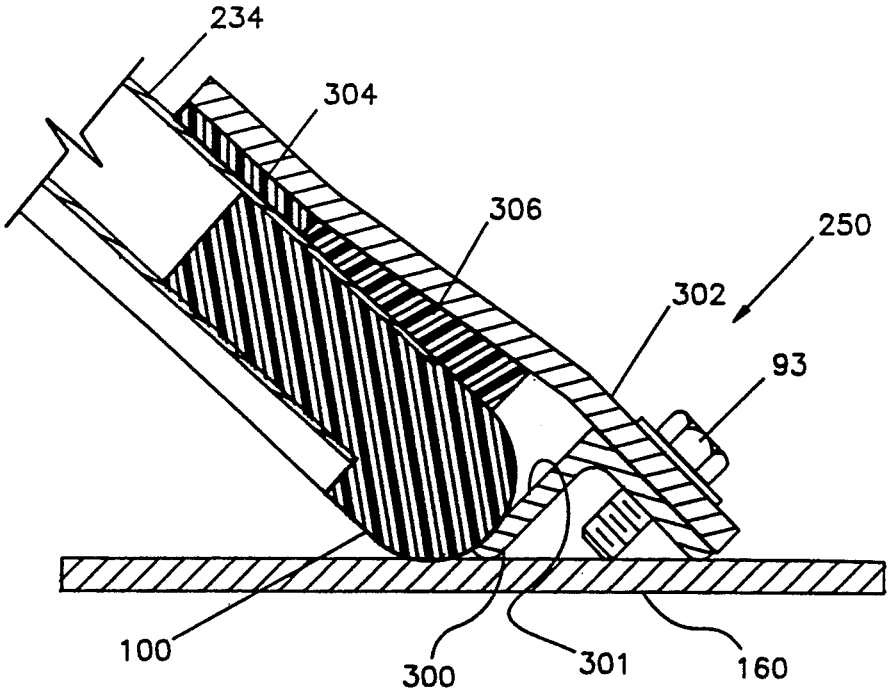
FIG. 22 is a cross section view seen generally in the direction 22—22 of FIG. 15 schematically illustrating details of a cover support arrangement for the dome shaped cover of FIG. 15.
Figure 20A:
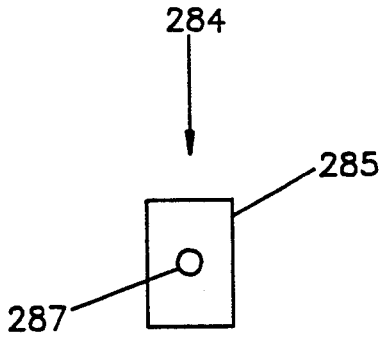
FIGS. 20A and 20B are plan and cross section views schematically illustrating a clamping block for the clamping arrangement of FIG. 18.
Figure 20B:
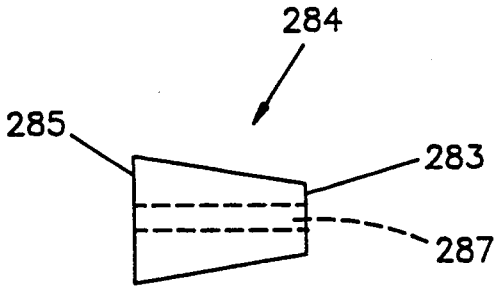
Figure 23:
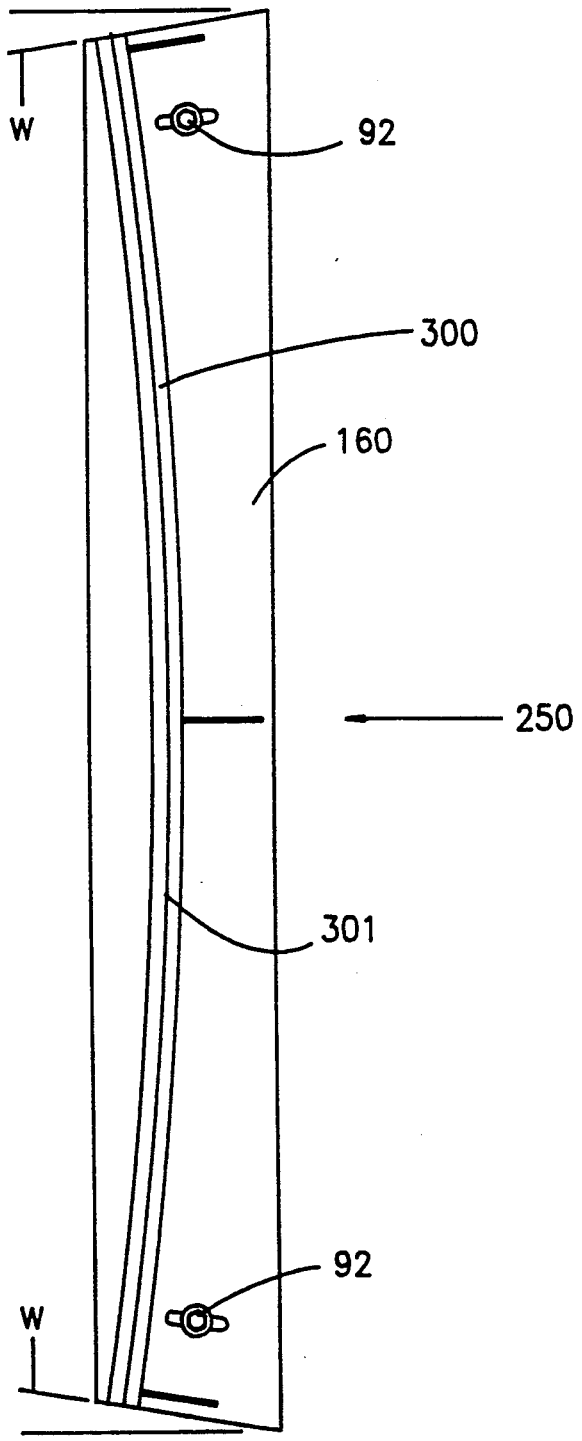
FIG. 23 is a plan view of a section of the cover support arrangement of FIG. 22.

A cover support arrangement 250 for cover 230 is illustrated in FIG. 22 and FIG. 23. An angle section 300 in the form of an arc of a circle is attached to each plate 160 of a series of such plates, attached to the top of the tank by bolts 92, to form cover support arrangement or tension ring 250. The angle sections 300 form a circular raised bearing surface 301 for receiving the ends of radial members 234. Adjacent the end of each radial member 234 a reinforcing plate 302 is attached to angle section 300, for example by a bolt 93. An end block 100 in the end of radial member 234 provides slidable engagement of the radial member with plate 160, and provides a substantially gas-tight seal between the radial member and the tension ring. A resilient rubbing strip 304 is preferably located between radial member 234 and reinforcing plate 302. Additionally, a flexible sealing material 306 may be located between plate 304 and radial member 234 for forming a secondary seal between the radial member and tension ring 250.

Figure 24:
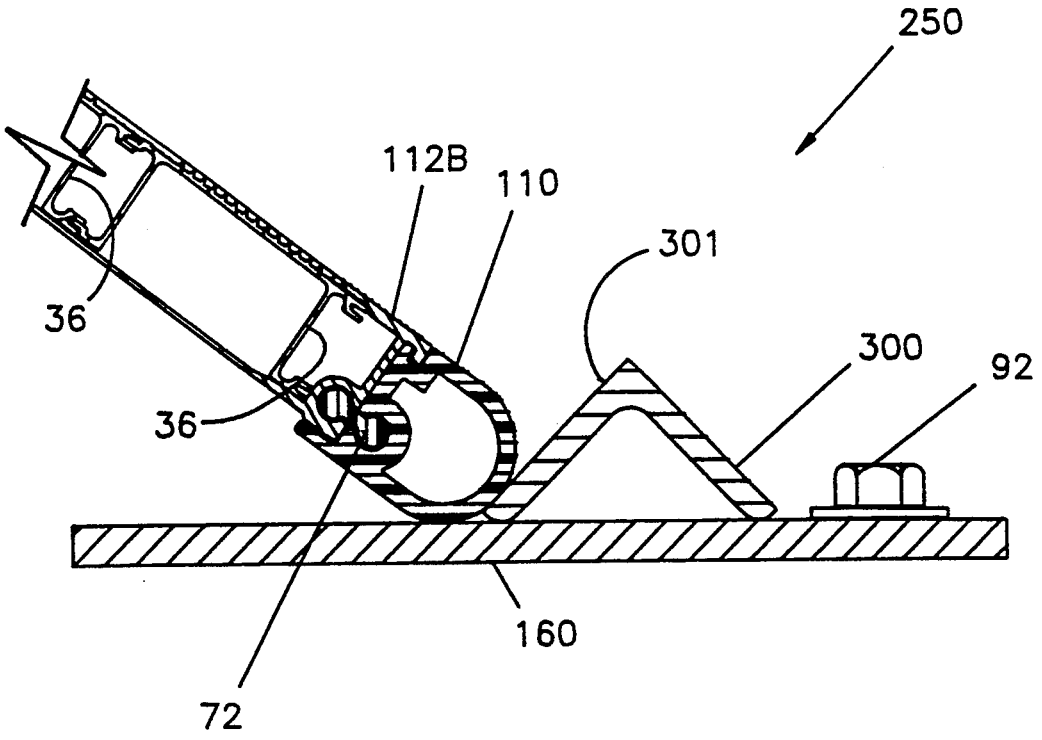
FIG. 24 is a cross section view seen generally in the direction 24—24 of FIG. 15 schematically illustrating a panel sealing method for the cover of FIG. 15.

To complete the description of cover 230, a method of sealing panels 232 to the tension ring and the compression unit is set forth. Referring again to FIGS. 18 and 19, and additionally to FIG. 24, panels 232 each preferably have a boundary member 112B attached to both the apex (see FIG. 19) and the base (see FIGS. 15 and 24) of the panels. Each boundary member has a sealing member 110 attached thereto, as described above for the panels of covers 30 and 30B. At the apex of a panel (see FIGS. 18 and 19), the sealing member engages plate 288 of bolt 286. At the base of a panel (see FIG. 24), the sealing member engages bearing surface 301 of tension ring 250. Together sealing members on panels 232, and end blocks 100 on radial members 234 effectively provide a cover which is substantially gas-tight.

The tank cover construction techniques described above may provide a substantially gas-tight seal for containment of all but a percentage of gas generally insufficient to provide objectionable odor in the vicinity of a tank. It is not represented, however, that such a cover is absolutely gas-tight for example as gas-tight as would be necessary to maintain a vacuum inside a tank. Clearly, the possibility of small amounts of leakage exists, for example at a junction of two seals, such as a junction between a sealing member 110 and an end block 100. One means of providing additional sealing or leakage control, for example, would be to spray a completed and assembled cover with a resilient sealing material such as PVC or with a rubberized paint. Such materials are well known to those familiar with the pertinent art.

In summary, embodiments of a field-erectable modular lightweight tank cover have been described. Components and component attachment methods are described which are common to different cover shapes and sizes. A majority of components may be conveniently fabricated from aluminum extrusions of relatively small section. Components of a cover may be packed into a container having a small volume relative to the dimension of the assembled cover. This, together with the lightness provided by the use of aluminum components, assists in reducing shipping costs. Further, extensive use of weldless interlocking connections between components may reduce field erection time and cost to less than half of the cost and time associated with more traditional structures and assembly methods.

The present invention has been described in terms of preferred and other embodiments. The present invention, however, is not limited to those embodiments described and depicted. Rather, the invention is defined by the appended claims.

What is claimed is:

1. A cover for an open-topped structure such as a tank, comprising:

a plurality of panels and a plurality of cross members, a multiplicity of planks forming each panel, said planks connected together edge-to-edge, and said panels arranged side-by-side with adjacent panels connected together by a cross member, the ends of said cross members engaging cover support means attached to the open-topped structure;

each of said panels having a side member extending transversely along at least one edge thereof, said side member having plank receiving means therein and said cross member and said side member each having connecting means therein for forming a substantially gas-tight connection therebetween; and a sealing member on each of the panels said sealing member engaging said cover support means for providing a substantially gas-tight seal therewith.

2. The cover of claim 1 wherein said plurality of panels and cross members are configured to provide a cover having the shape of an arch.

3. The cover of claim 1 wherein said plurality of panels and cross members are configured to provide a cover having the shape of a dome.

4. The cover of claim 1 wherein said connecting means further includes panel sealing means for providing a substantially gas-tight seal between said panels and said cross members.

5. A deck or cover structure for engaging with supporting border structure, comprising;

a plurality of generally rectangular panels having two generally parallel opposite sides and two opposite ends, and a plurality of cross members for supporting said panels;

said panels arranged side-by-side with adjacent panels connected together by said cross members, the ends of said cross members engaging cover support means attached to the supporting border structure;

each of said panels having a side member on each side thereof and including a multiplicity of edge-to-edge planks, each side member extending across the width of all of said planks and having a channel therein for receiving the ends of said planks, said planks being solely supported at their ends by the channel, and said panels connected and substantially sealed to said cross members by interconnecting means on said side members and said cross members; and first-type sealing means on the ends of each of said panels, said first-type sealing means engaging said cover support means for providing a substantially gas-tight seal therewith.

6. The cover structure of claim 5 further including two end panels, each end panel being generally rectangular and having two generally parallel opposite sides and two opposite ends, one of said opposite sides having a side member thereon, said side member attached to an end one of said cross members, and each end panel having said first-type sealing means on the other of said opposite sides and on both ends thereof.

7. The cover structure of claim 6 wherein said panels are generally rectangular, and said cross members are preformed into an arcuate shape such that said cover is rectangular and has the shape of an arch.

8. The cover structure of claim 5 wherein each of said panels has the shape of essentially a section of a circle and said side members are preformed into an arcuate shape.

9. The cover structure of claim 8 further including two end panels, one thereof at each end of the cover, each thereof having the shape of a section of a circle, said end panels each having one straight side having a side member thereon and one curved side having said first-type sealing means thereon, each end panel connected by said side member to an end one of said cross members.

10. The cover structure of claim 9 wherein said plurality of panels, said two end panels, and said plurality of cross members is configured such that the cover has a dome-like shape.

11. The cover of claim 5 wherein said panels are generally rectangular and said cover support means includes means for applying a compressive force to the ends of said cross members such that the cover is retained in the shape of an arch by said compressive force.

12. The cover structure of claim 5 wherein said interconnecting means includes:

an outwardly and downwardly hooking flange extending along a side member and an outwardly and upwardly hooking flange extending along a cross member, said flanges hooked together for connecting the panel to the cross member;

said side member including a first slit extending therealong below said outwardly and downwardly hooking flange, said first slit opening into a first tunnel-like groove in said side member, said cross member including a second slit extending therealong below said outwardly and upwardly hooking flange, said second slit opening into a second tunnel-like groove in said cross member, and said first and second slits substantially aligned with each other such that said slits and grooves define an elongated first interlocking-space having a dumbbell-shaped cross section; and a first resilient interlocking sealing strip having a generally dumbbell-shaped cross section, said sealing strip inserted within said interlocking space for sealing said panel side member to said cross member and for preventing said panel from being unintentionally disconnected from said support member.

13. The cover structure of claim 12 wherein said first-type sealing means includes a resilient sealing member on each end of each of said panels, and said cover support means includes horizontal cover support member and a vertical restraining-member, said sealing member engaging said cover support member and said restraining-member to form a substantially gas-tight seal therewith.

14. The cover structure of claim 13 further including means for attaching said sealing members to said panels.

15. The cover structure of claim 14 wherein said sealing member attaching means includes:

an upwardly hooking flange extending along a said sealing member;

a boundary member on each end of a panel, said boundary member including a channel for receiving an end one of the multiplicity of planks forming said panel, and said boundary member including an outwardly and downwardly hooking flange extending therealong, said outwardly and downwardly hooking flange engaging said upwardly hooking flange for connecting the sealing member to the boundary member;

said boundary member including a third slit extending therealong below said outwardly and downwardly hooking flange, said third slit opening into a third tunnel-like groove in said boundary member, and said sealing member including a fourth slit extending therealong below said upwardly hooking flange, said fourth slit opening into a fourth tunnel-like groove in said sealing member, said third and fourth slits substantially aligned with each other such that said grooves and slits together define a second interlocking-space having a generally dumbbell shaped cross section; and a second resilient interlocking sealing strip, said sealing strip having a generally dumbbell-shaped cross section, said second sealing strip inserted within said second interlocking-space for sealing said boundary member to said sealing member and for preventing said sealing member from being unintentionally disconnected from the said panel.

16. The cover structure of claim 5 further including second type sealing means on each of the ends of each of said cross members.

17. The cover structure of claim 5 further including means for providing a predetermined stiffness to said cross members.

18. The cover structure of claim 17 wherein said stiffness providing means includes at least one stiffening member attached to a predetermined length of said cross member.

19. A circular cover for an open-topped structure, the cover generally in the form of a dome, comprising:

a plurality of panels each in the form of a section of a circle, and a plurality of arcuate cross members;

all but two of said panels having two straight and generally parallel opposite sides and two opposite curved ends, said two panels having one straight side and one curved side;

said panels arranged side-by-side with the curved ends thereof lying generally on a circle, adjacent panels being connected together at the sides thereof by a cross member, and said cross members engaging a generally circular bracket attached to the top of the tank;

each of said panels including a multiplicity of edge-to-edge planks, a boundary member along each curved end thereof, and a side member along each straight edge thereof, each side member extending across the width of all of said planks and having a channel therein for receiving the ends of said planks, said planks being supported at their ends by the channel, and said panels connected and sealed to said cross members by connecting means on said side members and said cross members; and a first-type sealing member on each boundary member and a second-type sealing member on the ends of each cross member said first and second-type sealing members engaging said bracket for providing a substantially gas-tight seal between the cover and the tank.

20. The cover of claim 19 wherein said ends of cross members include means of providing slidable engagement with said bracket.

21. The cover of claim 19 wherein said bracket is an inward-facing L-shaped bracket.

22. The cover of claim 19 wherein said bracket is an inward-facing U-shaped bracket.

23. A dome-shaped cover for a tank, comprising:

a plurality of panels each generally in the form of a segment of a circle, and a plurality of arcuate radial members arranged alternately in a radial pattern, each panel including a multiplicity of planks connected together edge-to-edge, and said panels connected together by said radial members;

each of said panels having a side member extending along at least one edge thereof said side member having means therein for receiving said planks and said side member and radial member having connecting means for forming a connection therebetween; and said panels including sealing means for providing a substantially gas-tight seal between the cover and the tank.

24. The cover of claim 23 wherein one end of each of said radial members engages a compression unit located at the center of said radial pattern, and the other end of the support member engages a tension ring attached to the tank for supporting the cover on the tank.

25. A dome shaped cover for a tank, comprising:

a disc shaped compression unit having an outwardly facing channel therein;

a plurality of arcuate radial members arranged in a radial pattern with said compression unit at the center of said pattern, each radial member having a first end thereof engaging said channel and a second end thereof engaging a tension ring attached to the tank;

clamping means for securing said radial members to said compression unit;

a plurality of panels, each thereof generally in the shape of a segment of a circle and having an apex, a base and two sides, each of said panels including a side member along each side thereof and a multiplicity of edge-to-edge planks, each side member extending across the width of all of said planks and having a channel therein for receiving the ends of said planks, said planks being supported at their ends by said channel, and each panel connected and sealed by connecting means on said side members and said radial members between adjacent ones of said plurality of radial members with the apex of said panel adjacent the compression unit; and first-type sealing means for forming a seal between said panels and said compression unit and between said panels and said tension ring.

26. The cover of claim 25 wherein said compression unit includes a compression ring having first and second annular portions assembled together generally concentrically thereon to form said outwardly facing channel.

27. The cover of claim 26 wherein said clamping means includes a plurality of resilient wedge-shaped blocks, one thereof attached by a bolt to said compression ring between each pair of support members, said bolt tightened by a nut on an end thereof inside of the compression ring, and said bolt having a plate at an end thereof outside the compression ring, whereby when said bolt is tightened said wedge shape block is compressed and clamps said radial members to said compression unit.

28. The cover of claim 25 wherein said tension ring includes a baseplate and an angle section, said angle section attached to the baseplate to form a raised bearing surface thereon for receiving said second ends of said radial members.

29. The cover of claim 25 further including second type sealing means for forming a seal between said second ends of said support members and said tension ring.

30. The cover of claim 25 further including means for providing slidable engagement between said second ends of said radial members and said tension ring.

31. The cover of claim 25 further including means for imparting a predetermined stiffness to said radial members 32. The cover of claim 25 wherein said connecting means includes:

an outwardly and downwardly hooking flange extending along a side member and an outwardly and upwardly hooking flange extending along a radial member, said flanges hooked together for connecting the panel to the radial member;

said side member including a first slit extending therealong below said outwardly and downwardly hooking flange, said first slit opening into a first tube-like groove in said side member, and said radial member including a second slit extending therealong below said outwardly and upwardly hooking flange, said second slit opening into a second tube-like groove in said support member, said first and second slits substantially aligned with each other such that said slits and grooves form an elongated first interlocking-space having a generally dumbbell-shaped cross section; and a resilient interlocking seal-strip having a generally dumbbell-shaped cross section, said seal-strip inserted within said locking-space for sealing said side member to said radial member and for preventing said panel from being unintentionally disconnected from said radial member.

33. The cover of claim 25 wherein said first-type sealing means includes a first resilient sealing member at the apex of each panel and a second resilient sealing member at the base of each panel, said first sealing member engaging said clamping means and said second sealing member engaging said raised bearing surface of said tension ring.

34. In an interconnected, field-erectable deck or cover structure having structural cross members and planks for extending between the cross members, an interconnection system comprising:

side members for connecting between the structural cross members and the planks, for engagement with each, and including means for receiving the ends of planks in transverse relationship to the cross member;

interconnecting means for securing the side members to the cross members in side by side parallel relationship;

an outwardly and downwardly hooking flange extending along a side member and an outwardly and upwardly hooking flange extending along a cross member, said flanges hooked together for connecting the side member to the cross member;

said side member including a first slit extending therealong below said outwardly and downwardly hooking flange, said first slit opening into a first tunnel-like groove in said side member, said cross member including a second slit extending therealong below said outwardly and upwardly hooking flange, said second slit opening into a second tunnel-like groove in said cross member, and said first and second slits substantially aligned with each other such that said slits and grooves define an elongated first interlocking-space having a dumbbell-shaped cross section; and a first resilient interlocking strip having a generally dumbbell-shaped cross section, said strip inserted within said interlocking space for securing said side member to said cross member.

* * * * *